US011015418B2

(12) United States Patent
Burris et al.

(10) Patent No.: US 11,015,418 B2
(45) Date of Patent: May 25, 2021

(54) TUBING PRESSURE INSENSITIVE FAILSAFE WIRELINE RETRIEVABLE SAFETY VALVE

(71) Applicants: John Burris, Bixby, OK (US); Jason Edwards, Broken Arrow, OK (US); Wade Miller, Broken Arrow, OK (US); Ronald J. Garr, Inola, OK (US)

(72) Inventors: John Burris, Bixby, OK (US); Jason Edwards, Broken Arrow, OK (US); Wade Miller, Broken Arrow, OK (US); Ronald J. Garr, Inola, OK (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/431,373

(22) Filed: Jun. 4, 2019

(65) Prior Publication Data

US 2019/0376366 A1 Dec. 12, 2019

Related U.S. Application Data

(63) Continuation-in-part of application No. 16/001,604, filed on Jun. 6, 2018, now Pat. No. 10,745,997.

(51) Int. Cl.

| | |
|---|---|
| ***E21B 34/06*** | (2006.01) |
| ***E21B 34/14*** | (2006.01) |
| ***E21B 34/10*** | (2006.01) |

(52) U.S. Cl.

CPC ..... *E21B 34/063* (2013.01); *E21B 34/10* (2013.01); *E21B 34/14* (2013.01); *E21B 2200/05* (2020.05)

(58) Field of Classification Search

CPC ..... E21B 34/14; E21B 34/063; E21B 34/10; E31B 2034/005; E31B 2200/05

See application file for complete search history.

(56) References Cited

U.S. PATENT DOCUMENTS 4,252,197 A * 2/1981 Pringle ..... E21B 34/105 166/322
4,325,431 A * 4/1982 Akkerman ..... E21B 34/107 166/117.5

(Continued)

FOREIGN PATENT DOCUMENTS

WO 2010056783 A2 5/2010

OTHER PUBLICATIONS

International Search Report for International Application No. PCT/US2019/035508 International Filing date Jun. 5, 2019; dated Sep. 16, 2019; 3 pages.

(Continued)

*Primary Examiner* — Aaron L Lembo
(74) *Attorney, Agent, or Firm* — Cantor Colburn LLP

(57) ABSTRACT

A tubing pressure insensitive failsafe wireline retrievable safety valve, borehole system having the valve and method of operation of the valve. The valve includes a tool housing, a flow tube disposed within the tool housing, an actuation piston disposed in the tool housing and operably connected to the flow tube, the actuation piston having an actuation side and a pressure side, and a fluid pathway between a potential leak site for the valve and the pressure side of the piston. A temporary sealing member is in the fluid pathway between the potential leak site and the pressure side of the piston. The method includes disposing the valve at a selected location and removing at least a portion of the temporary sealing member from the fluid pathway after landing the wireline retrievable safety valve at the selected location.

27 Claims, 20 Drawing Sheets

(56) References Cited

U.S. PATENT DOCUMENTS 4,393,930 A 7/1983 Ross et al.
4,658,902 A 4/1987 Wesson et al.
4,660,646 A 4/1987 Blizzard
5,251,702 A * 10/1993 Vazquez ..... E21B 34/107 166/324
5,310,004 A 5/1994 Leismer
6,109,351 A * 8/2000 Beall ..... E21B 34/10 166/321
6,125,930 A 10/2000 Moyes
6,173,785 B1 * 1/2001 Adams ..... E21B 34/10 166/375
6,269,874 B1 8/2001 Rawson et al.
6,302,210 B1 * 10/2001 Crow ..... E21B 34/10 166/324
6,513,594 B1 * 2/2003 McCalvin ..... E21B 34/10 166/320
6,866,101 B2 * 3/2005 Sloan ..... E21B 34/10 166/375
7,552,774 B2 * 6/2009 Anderson ..... E21B 34/101 166/319
7,591,317 B2 * 9/2009 Bane ..... E21B 34/10 166/375
7,694,742 B2 4/2010 Bane et al.
7,743,833 B2 * 6/2010 Cascario ..... E21B 34/10 166/375
7,954,550 B2 * 6/2011 Anderson ..... E21B 34/102 166/321
8,176,975 B2 * 5/2012 Lake ..... E21B 34/08 166/66.7
8,616,291 B2 * 12/2013 Smith ..... E21B 34/10 166/324
8,662,187 B2 * 3/2014 Lake ..... E21B 34/066 166/373
8,857,785 B2 * 10/2014 Bussear ..... F16K 31/025 166/66.7
9,810,343 B2 11/2017 Miller et al.
2002/0074129 A1 * 6/2002 Moore ..... E21B 34/10 166/375
2006/0086509 A1 4/2006 McMillan et al.
2008/0110611 A1 5/2008 Bane et al.
2008/0128137 A1 6/2008 Anderson et al.
2008/0314599 A1 12/2008 Bane et al.
2010/0116502 A1 5/2010 Anderson
2016/0138365 A1 5/2016 Vick, Jr. et al.
2018/0334883 A1 11/2018 Williamson

OTHER PUBLICATIONS

Written Opinion for International Application No. PCT/US2019/035508 International Filing date Jun. 5, 2019; dated Sep. 16, 2019; 6 pages.

* cited by examiner

TUBING PRESSURE INSENSITIVE FAILSAFE WIRELINE RETRIEVABLE SAFETY VALVE

CROSS REFERENCE TO RELATED APPLICATIONS

The present application is a continuation-in-part of U.S. patent application Ser. No. 16/001,604, file on Jun. 6, 2018, the contents of which are incorporated herein by reference in their entirety.

BACKGROUND

Surface Controlled Subsurface Safety Valves (SCSSV) are well known components of the hydrocarbon recovery and other subsurface resource recovery industries. So too are replacement safety valves such as wireline retrievable safety valves (WRSV) that may be disposed within a landing nipple or within an existing and otherwise inoperable tubing retrievable safety valve (TRSV) that is downhole. WRSVs are commonly inserted within non-functioning TRSVs to enable continued production of an oil and gas well without assuming the large costs associated with retrieving and replacing the TRSV. When installed within a TRSV, operation of the WRSV can be accomplished via the control line running to the original TRSV by penetrating a fluid chamber fed by that control line. In so doing, the WRSV and TRSV hydraulic systems are effectively coupled together. Due to the coupling of the two systems, a key design aspect for all WRSVs is that they must be able to function within the hydraulic operating parameters of the TRSVs within which they are intended to be installed. TRSV and WRSV designs are thus closely related.

Within the present-day SCSSV Industry, the majority of conventional TRSV and WRSV designs are "tubing pressure sensitive," meaning the valves require a hydraulic supply pressure that is greater than the local wellbore pressure in order to actuate to the open position. However, for deep-water and ultra-deep setting depth SCSSV applications, various known challenges (including hydraulic pressure rating limitations, wellhead design restrictions, etc.) prohibit the use of a tubing pressure sensitive style of safety valve altogether. Addressing this issue, manufacturers have developed various forms of unique "tubing pressure insensitive" TRSV configurations with low hydraulic operating pressures and additional safeguards built-in to prevent a fail-open scenario (due to tubing pressure ingress). With the advent of these new TRSV offerings, a significant drawback has always been the inability to operate an equivalent conventional WRSV at the same setting depth and hydraulic pressure. Consequently, in the event a tubing pressure insensitive TRSV becomes inoperable after a period of time downhole, in most cases there are no known WRSV offerings available to quickly and affordably install to bring the well back to a flowing condition. To that end, the art will welcome a low operating pressure, tubing pressure insensitive WRSV to service this important role.

SUMMARY

Disclosed herein is a tubing pressure insensitive failsafe wireline retrievable safety valve. The valve includes a tool housing, a flow tube disposed within the tool housing, an actuation piston disposed in the tool housing and operably connected to the flow tube, the actuation piston having an actuation side and a pressure side, and a fluid pathway between a potential leak site for the valve and the pressure side of the piston.

Also disclosed herein is a borehole system having a tubing pressure insensitive failsafe wireline retrievable safety valve. The borehole system includes a tool housing, a flow tube disposed within the tool housing, an actuation piston disposed in the tool housing and operably connected to the flow tube, the actuation piston having an actuation side and a pressure side, and a fluid pathway between a potential leak site for the valve and the pressure side of the piston.

Also disclosed herein is a method of operating a tubing pressure insensitive failsafe wireline retrievable safety valve. The valve includes a tool housing, a flow tube disposed within the tool housing, an actuation piston disposed in the tool housing and operably connected to the flow tube, the actuation piston having an actuation side and a pressure side, a fluid pathway between a potential leak site for the valve and the pressure side of the piston, and a temporary sealing member in the fluid pathway between the potential leak site and the pressure side of the piston. The method includes disposing the valve at a selected location and removing at least a portion of the temporary sealing member from the fluid pathway after landing the wireline retrievable safety valve at the selected location.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
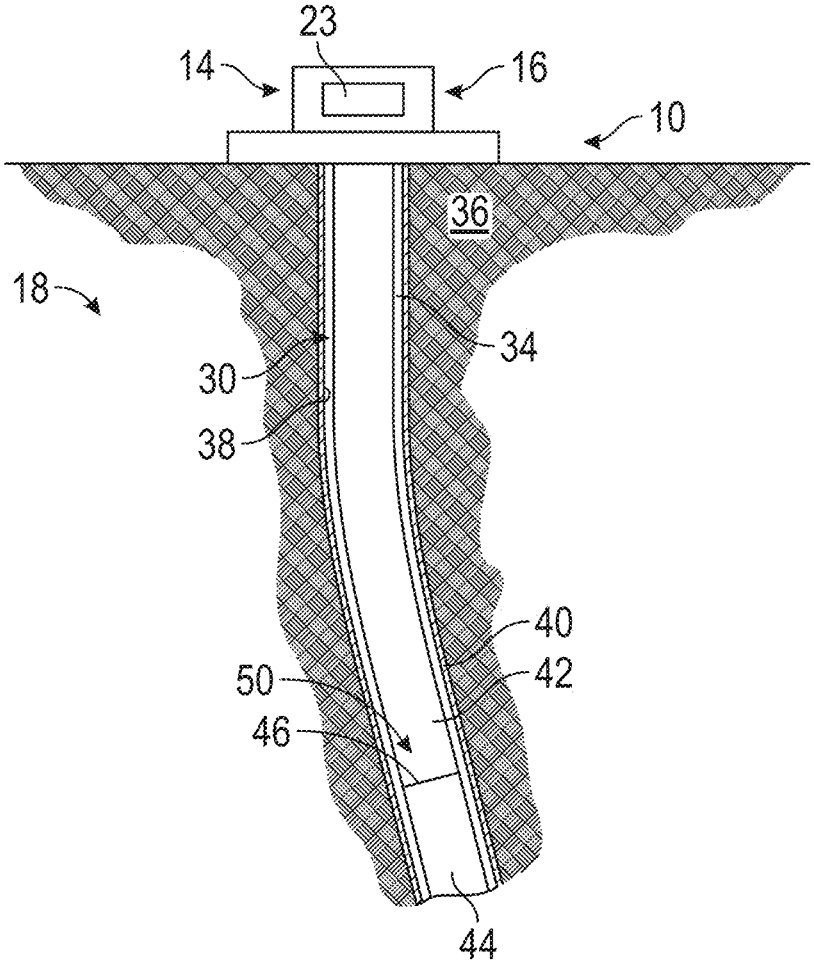
FIG. 1 depicts a resource exploration and recovery system including a system for isolating and relieving pressure across a threaded connection, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Wellbore 34 includes an annular wall 38 defined by a casing tubular 40. Tubular string 30 may be formed by a series of interconnected discrete tubulars including a first tubular 42 connected to a second tubular 44 at a joint 46. A pressure communication system 50 provides a pathway for pressure that may be embodied in a gas and/or a liquid, to pass between first tubular 42 and second tubular 44 across joint 46.

Figure 2A:
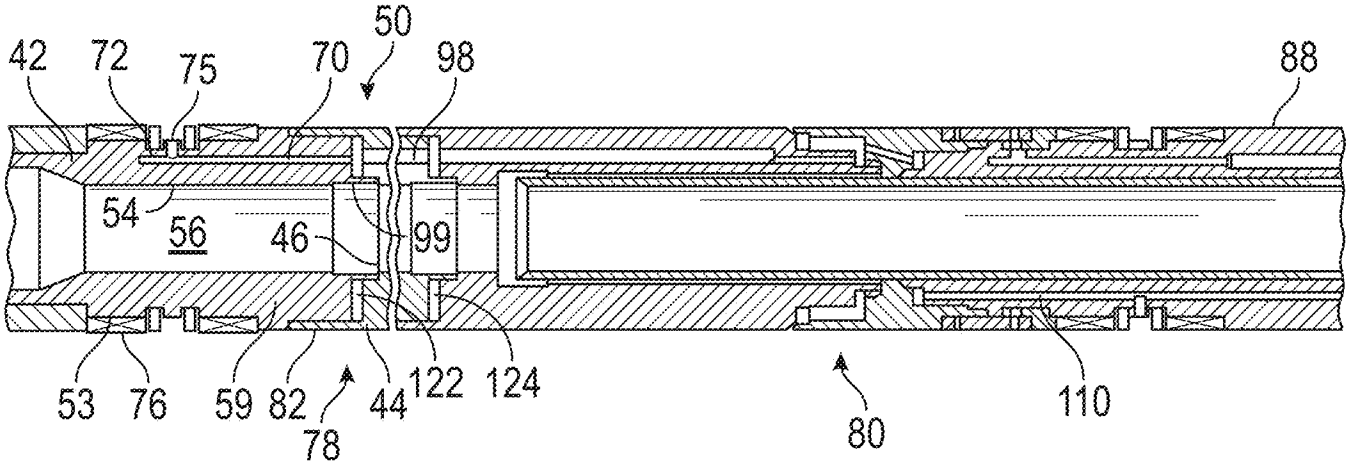
FIG. 2A depicts a first portion of a tubular system of the resource exploration and recovery system of FIG. 1 including the system for isolating and relieving pressure across a threaded connection, in accordance with an aspect of an exemplary embodiment.
Figure 2B:
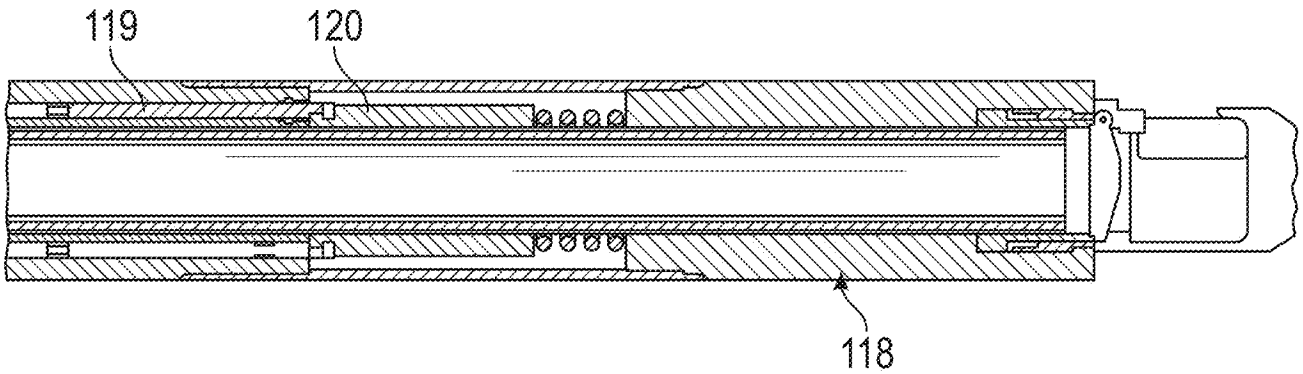
FIG. 2B depicts a second portion of the tubular system of the resource exploration and recovery system of FIG. 1 including a valve system, in accordance with an aspect of an exemplary embodiment.
Figure 3:
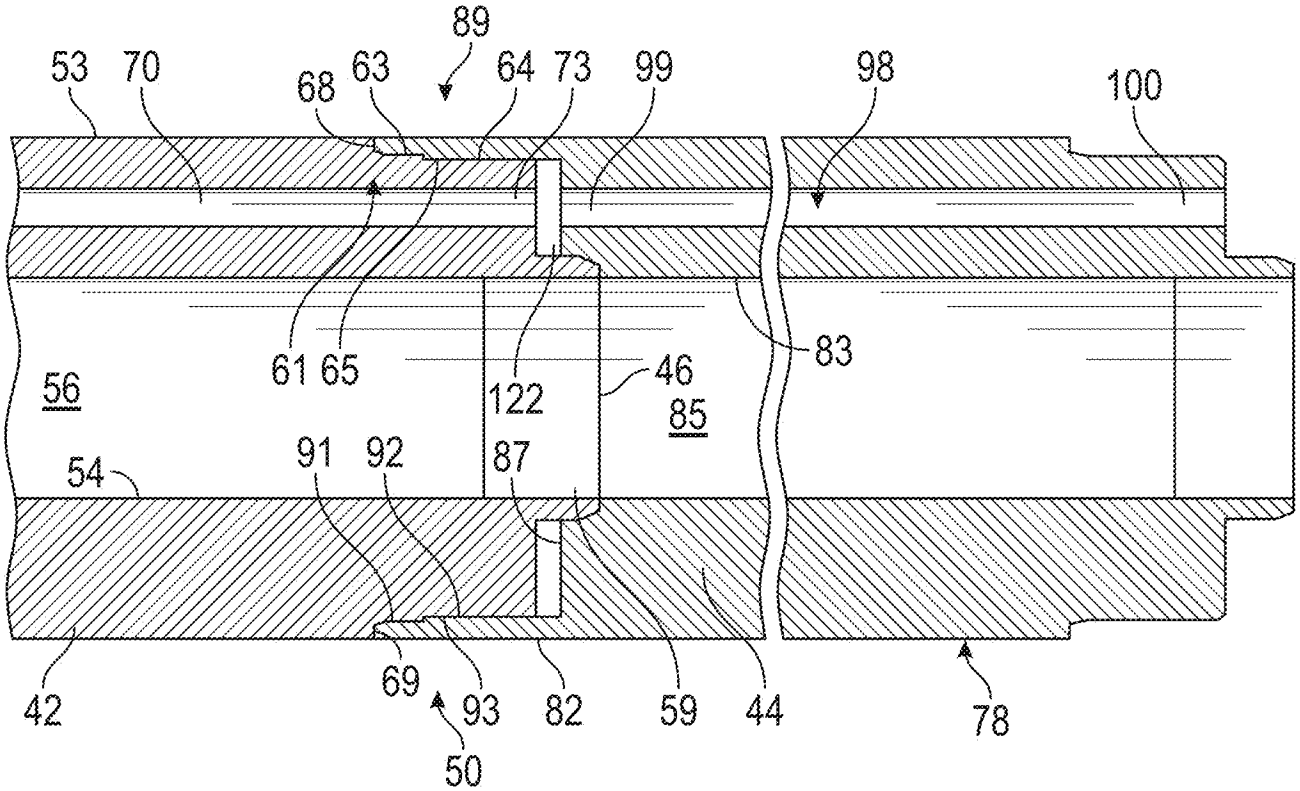
FIG. 3 depicts a connector forming the system for isolating and relieving pressure across a threaded connection, in accordance with an aspect of an exemplary embodiment.

As shown in FIGS. 2A, 2B, and 3, first tubular 42 includes an outer surface 53, an inner surface 54 that defines a central passage 56, and a terminal end 59. A first connector portion 61 (FIG. 3) is arranged at terminal end 59. In an embodiment, first connector portion 61 includes a first surface section 63, a second surface section 64, and a step 65 provided therebetween. Second surface section 64 may include a plurality of external threads (not separately labeled). A torque shoulder 68 may be created by a surface (not separately labeled) perpendicular to or at an angle to the surfaces. Torque shoulder 68 may transfer loads to or from a mating torque shoulder 69. These loads may be created by either tightening of a threaded connection, induced by pressure, or other outside forces. A first conduit 70 is formed between outer surface 53 and inner surface 54. First conduit 70 includes a first end 72 and a second end 73 that is exposed at terminal end 59. An inlet 75 may be provided at first end 72. Inlet 75 may be fluidically exposed to wellbore 34 if a packing element 76 provided on outer surface 53 of first tubular 42 were to leak for any reason.

In an embodiment, second tubular 44 may take the form of a coupler 78 that provides an interface between first tubular 42 and a third tubular 80. It should however be understood that second tubular 44 need not be limited to being a coupler. Second tubular 44 includes an outer surface section 82, an inner surface section 83 that defines a central passage 85, and a terminal end section 87. Third tubular 80 includes an outer surface section 88. Second tubular 44 includes a second connector portion 89 at terminal end section 87. In an embodiment, second connector portion 89 includes a first surface portion 91, a second surface portion 92 and a step portion 93 provided therebetween. Second surface portion 92 may include a plurality of internal threads (not separately labeled).

In an embodiment, second tubular 44 includes a second conduit 98 arranged between outer surface section 82 and inner surface section 83. Second conduit 98 includes a first end section 99 and a second end section 100 that may be fluidically connected to a third conduit 110 formed in third tubular 80. It should be understood that the number and orientation of first conduit 70, second conduit 98, and third conduit 110 may vary. In an embodiment, third conduit 110 may be fluidically connected to a valve system 118 and operable to provide a balancing pressure from wellbore 34, first tubular 42, and/or second tubular 44 to a piston 119 that forms part of a valve actuator 120.

In an embodiment, a first annular chamber 122 is defined between terminal end 59 and terminal end section 87. Another annular chamber 124 may be defined between second tubular 44 and third tubular 80. In accordance with an exemplary embodiment, annular chamber 122 promotes fluid and/or pressure communication between first conduit 70 and second conduit 98. More specifically, annular chamber permits first conduit 70 to be circumferentially or annularly misaligned relative to second conduit 98 without affecting fluid flow.

Figure 4:
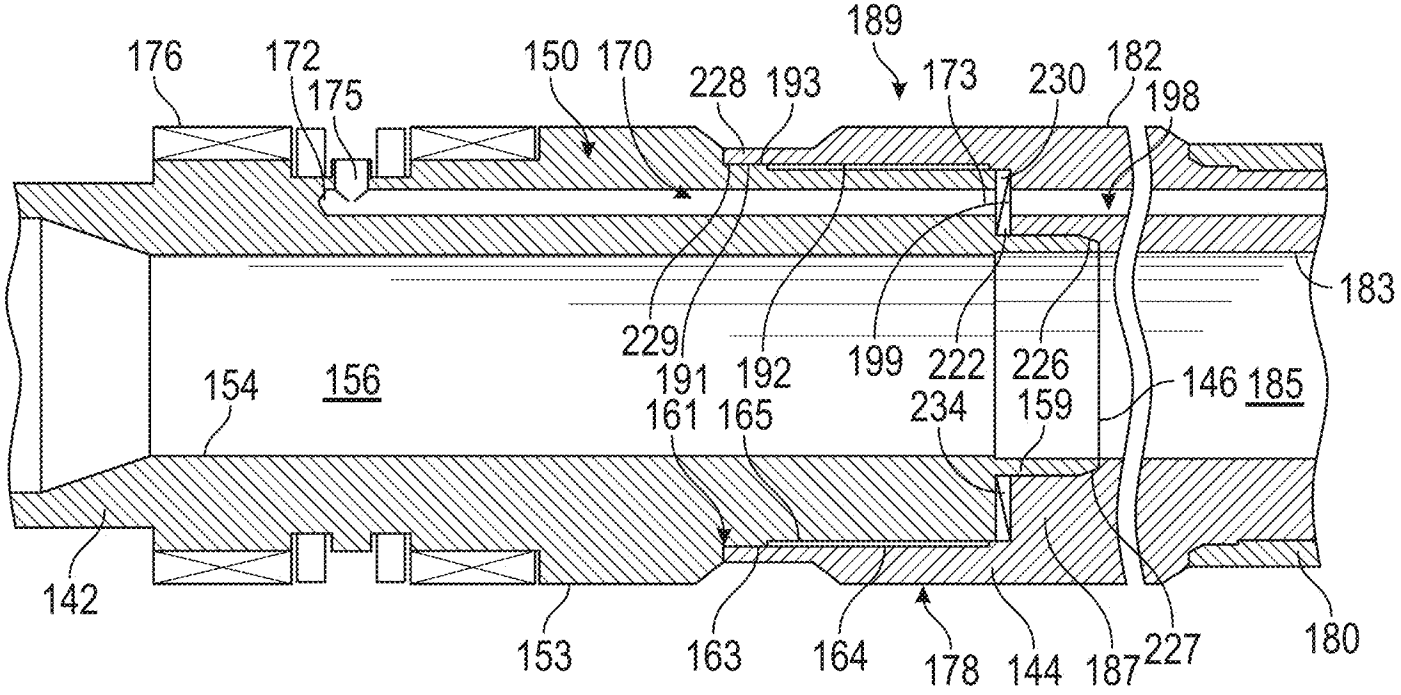
FIG. 4 depicts a system for isolating and relieving pressure across a threaded connection, in accordance with another aspect of an exemplary embodiment.
Figure 5:
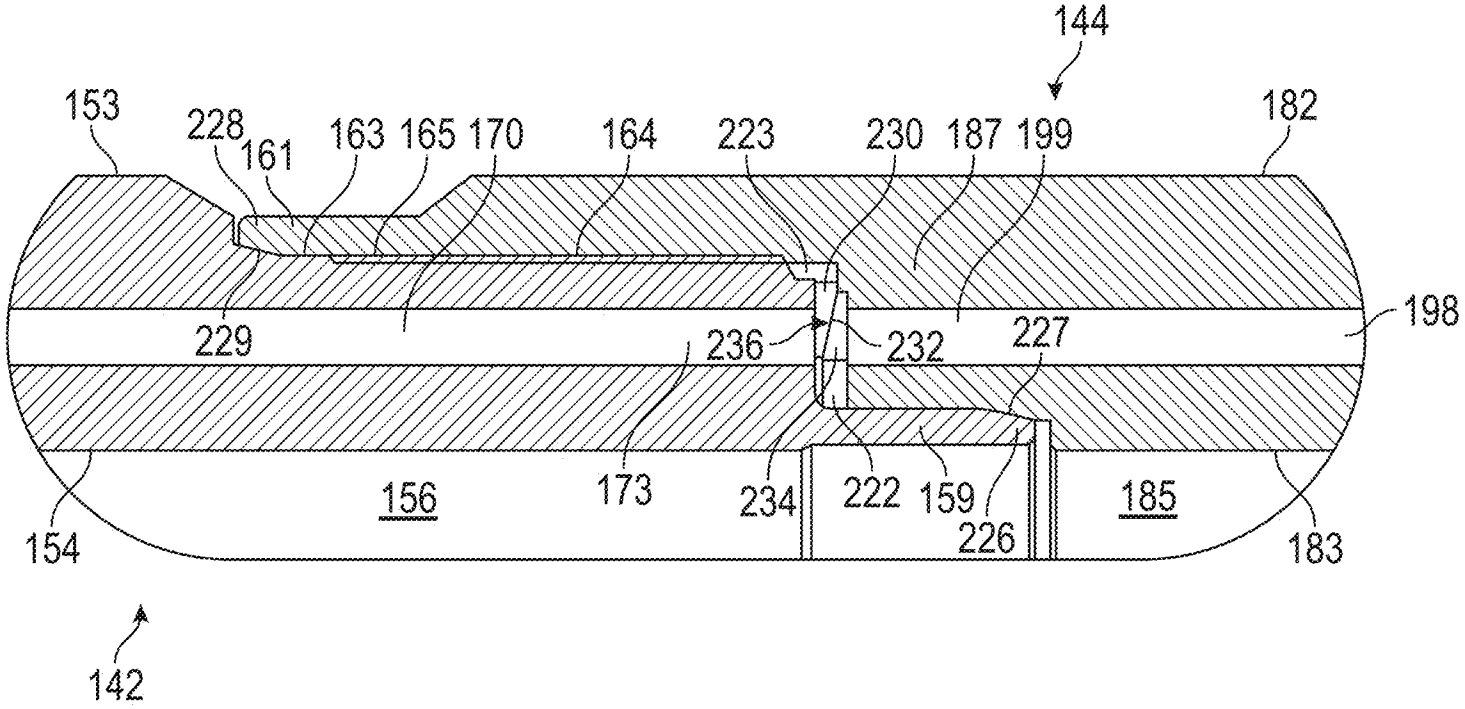
FIG. 5 depicts a connector of the system of FIG. 4, in accordance with an aspect of an exemplary embodiment.

As shown in FIGS. 4 and 5 a first tubular 142 is coupled to a second tubular 144 at a joint 146. A pressure communication system 150 is provided in first tubular 142 and second tubular 144 across joint 146. First tubular 142 includes an outer surface 153, an inner surface 154 that defines a central passage 156 and a terminal end 159. A first connector portion 161 is arranged at terminal end 159. In an embodiment, first connector portion 161 includes a first surface section 163, a second surface section 164, and a step 165 provided therebetween. First surface section 163 may include a plurality of external threads (not separately labeled). A first conduit 170 is formed between outer surface 153 and inner surface 154. First conduit 170 includes a first end 172 and a second end 173 that is exposed at terminal end 159. An inlet 175 may be provided at first end 172. Inlet 175 may be fluidically exposed to wellbore 34 at all times or only at limited times such as when any packing element 176 provided on outer surface 153 have leaked pressure for any reason.

In an embodiment, second tubular 144 may take the form of a coupler 178 that provides an interface between first tubular 142 and a third tubular 180. It should however be understood that second tubular 144 need not be limited to being a coupler. Second tubular 144 includes an outer surface section 182, an inner surface section 183 that defines a central passage 185, and a terminal end section 187. Second tubular 144 includes a second connector portion 189 at terminal end section 187. In an embodiment, second connector portion 189 includes a first surface portion 191, a second surface portion 192 and a step portion 193 provided therebetween. Second surface portion 192 may include a plurality of internal threads (not separately labeled). When joined, first connector portion 161 and second connector portion 189 form a connection (not separately labeled).

In an embodiment, second tubular 144 includes a second conduit 198 arranged between outer surface section 182 and inner surface section 183. Second conduit 198 includes a first end section 199 and a second end section (not shown) that may be fluidically connected to a third conduit (also not shown) formed in third tubular 180. In an embodiment, an inner annular chamber 222 and an outer chamber 223 are defined between terminal end 159 and terminal end section 187.

As discussed herein, inner annular chamber 222, and outer annular chamber 223 promote fluid and/or pressure communication between first conduit 170 and second conduit 198. More specifically, annular chambers 222 and 223 may be fluidically connected by so as to permit first conduit 170 to be circumferentially or annularly misaligned relative to second conduit 198 without affecting fluid flow. In addition, a seal land 226 may be provided at terminal end 159 of first tubular 142. Sealing land 226 includes an angled surface 227. Sealing land 226 has an interference fit with second tubular 144 to create a seal that inhibits fluid that may be inside of tubular string 30 from flowing into inner annular chamber 222. Another seal land 228 may be similarly provided at first connector portion 161 of second tubular 144. Sealing land 228 includes an angled surface 229. Sealing land 228 has a slight interference fit with first tubular 142 to create a seal that inhibits fluid that may be outside of tubular string 30 from flowing into outer annular chamber 223.

A torque shoulder 230 of the first tubular 142 may include an angled face 232 to carry loads created by either tightening of a threaded connection, induced by pressure, or other outside forces. A torque shoulder 234 may include an angled face 236 to carry the same types of loads to or from second tubular 144. The position of the angled faces 232 and 236 may also provide a selected position of the angled surfaces 227 and 229, of sealing lands 226 and 228 respectively, to provide the interference fit required to affect a reliable metal-to-metal seal.

Figure 6:
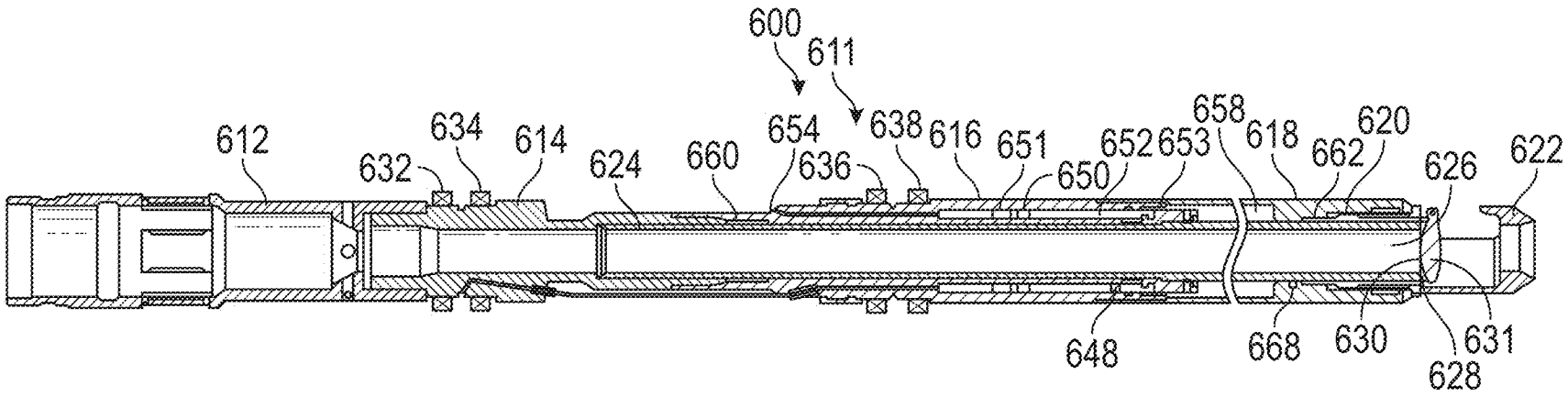
FIG. 6 illustrates a wireline retrievable safety valve (WRSV) in a closed position.
Figure 7:
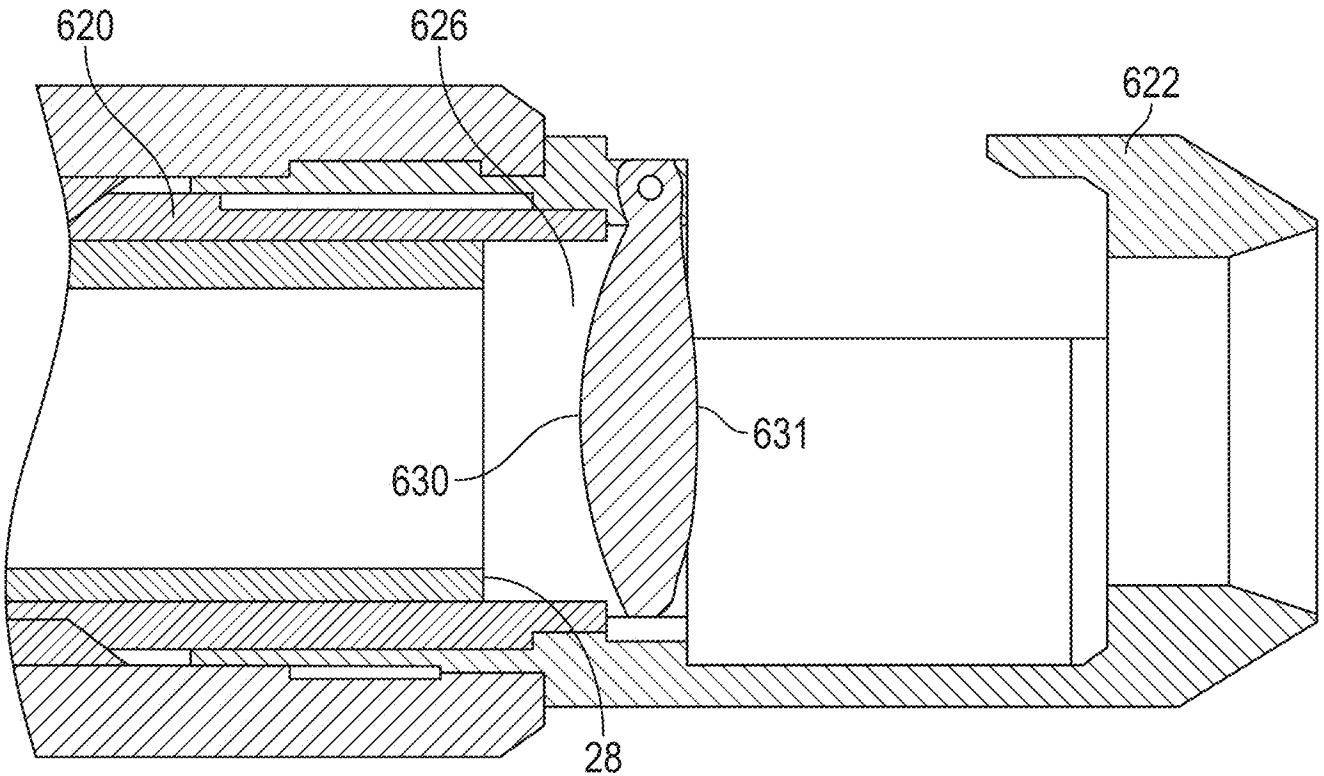
FIG. 7 is an enlarged view of a portion of FIG. 6 including the flapper housing.

Referring to FIG. 6, a WRSV 600 is illustrated in a closed position. The WRSV 600 is configured specifically to fail closed rather than open to remove unsafe operating conditions and additional maintenance procedures. The WRSV 600, arbitrarily starting at the uphole end of the tool, exteriorly comprises a tool housing 611 having top sub 612, a spacer sub 614, a piston housing 616, a spring housing 618 a flapper seat 620 and a flapper housing 622. The tool housing can be a lock for locating and securing the WRSV in an appropriate location within a tubing string (e.g., within a landing nipple or an otherwise non-function tubing retrievable SCSSV). A flow tube 624 is disposed slidingly within the tool housing 611 and specifically within the spacer sub 614, the piston sub 616, the spring housing 618 and the flapper housing 622. The flow tube 624 generally works as all flow tubes in safety valves do but as described herein the flow tube 624 is configured to define a space 626 between an end 628 of the flow tube 624 and a flapper 631 having a seal surface 630 (see FIG. 7). The space 626 provides for stroke of the flow tube 624 before the flapper 631 would be forced open. This is unusual since conventional wisdom would dictate that the flow tube immediately contact the flapper 631 to open the same in order to shorten the overall actuation stroke requirements of the tool. Not so in the first embodiment of the tubing pressure insensitive failsafe wireline retrievable safety valve as disclosed herein. The flow tube end 628 is constructed to be as disclosed in order to provide stroke of other components as well as the flow tube 624 itself so that the failsafe nature of the tool is realized. This will become clearer hereunder.

Continuing with the construction of the WRSV 600, at the outside diameter of the WRSV 600 are first seals 632, 634, and second seals 636, 638 that are sealable against a seal bore of a preexisting tubular (not shown) that may be an SCSSV, for example. The positioning of a WRSV within a SCSSV is well known to the art and need not be shown or described further herein. Between seals 632 and 634 is an opening 640 that leads to a conduit 642 connected to a temporary sealing element which in this embodiment is a fluid exclusion piston 644 disposed within housing 611. The conduit 642 may be within the housing 611 or may be a separate tubular structure connected to the housing 611 or may be both (as shown) so long as it provides a fluid pathway to the fluid exclusion piston 644. The conduit 642 is also intersected by a port 646 disposed in housing 611 between seals 636/638. Constructed as such, fluid leaking past any of seals 632, 634, 636, 638 will be communicated to the conduit 642 and thence to the fluid exclusion piston 644. Fluid exclusion piston 644 includes a seal ring 648. It is to be appreciated that the seal ring 648 is much farther to the right in the drawing than another seal ring 650 disposed upon a primary piston or actuation piston 652. This is important to function of the WRSV 600 and will become clearer upon the discussion of operation below. The actuation piston 652 is operable to move the flow tube 624 from a closed position to an open position (illustrated in FIG. 8) upon pressure input through inlet 654 to an actuation side 651 of actuation piston 652. It will be appreciated by one of ordinary skill in the art that for a WRSV of this general type, hydraulic control fluid is supplied to the valve's control system through an existing TRSV or Landing Nipple that has been accessed (e.g. by cutting) downhole. After landing the WRSV properly within the TRSV or Landing Nipple, control fluid from the host floods the annular volume defined between the seals 634 and 636 and provides the needed pressure control to operate the WRSV. Hence added pressure in this annular volume (not shown) will increase pressure on actuation side 651 of actuation piston 652 causing that piston to actuate the flow tube and accordingly, the flapper 631 in normal use operations. It is also important to note that the spring housing 618 defines a pressure chamber 658, such as an atmospheric chamber. Pressure chamber 658 is defined within spring housing 618, piston housing 616, flow tube 624, fluid exclusion piston 644 with seal ring 648, actuation piston 652 with seal ring 650 and two additional seals 660 and 662 on the flow tube 624. Incidentally, it is this pressure chamber 658 that allows for reduced pressure requirements to actuate the WRSV 600. The pressure chamber 658 includes a spring therein (shown in FIGS. 9-13 and 17-20) that biases the flow tube 624 towards the closed position of FIG. 6. The spring is designed to overcome the hydrostatic pressure of the hydraulic control fluid supplied to the valve as well as the weight internal of moving parts (e.g., Flow Tube, Pistons, etc.). In standard WRSVs, applied hydraulic control pressure has to overcome both the spring and wellbore pressure in order to move the flow tube 624. In the present invention, given pressure chamber 652 is fully isolated from wellbore pressure (via seals 660 and 662), the applied hydraulic control pressure has to overcome only the force of the spring in order to move the flow tube 624. Since the actuation piston 652 experiences only the change in pressure between the actuation fluid and the pressure chamber (plus spring force), the actuation piston 652 does not need to overcome wellbore pressure to actuate the flow tube 624.

During normal operation, increased pressure at inlet 654 will cause actuation piston 652 to urge the flow tube 624 toward the flapper 631 forcing the flapper 631 to open. Decreased pressure at inlet 654 will allow the flow tube 624 to move to the closed position under impetus of the spring Leaks at any of seals 632, 634, 636, 638 would traditionally have potentially created a fail open situation by allowing wellbore pressure to access inlet 654 and pressurize the actuation piston 652 at actuation side 651 to a level greater than the pressure at the pressure side 653 of the actuation piston 652. However, as configured in accordance with the teaching herein, the WRSV 600 is configured to fail to the closed position in all failure modes, even with leaks at any of seals 632, 634, 636, 638. This is because regardless of which seal 632, 634, 636 or 638 begins to leak, pressure will necessarily find its way to opening 640 or port 646, and will ultimately be communicated via pathway 647 (which comprises in the figure for example only opening 640, port 646, conduit 642 and pressure chamber 658 with the option of fluid exclusion piston 644 being disposed within the pathway 647) to the pressure side 653 of actuation piston 652. In this condition the valve 600 will always fail closed. All failure modes result in either higher pressure on the pressure side 653 of the actuation piston 652 than on the actuation side 651 or the pressure across actuation piston 652 is balanced (resulting in an essentially static condition). There never is a scenario where wellbore fluid ingress into the WRSV's hydraulic operating system could result in a pressure accumulation on the actuation side 651 of actuation piston 652 without a simultaneous and proportional build-up of pressure on the pressure side 653 of the same piston 652. The possibilities are that one of seal 632 or 638 fails allowing wellbore pressure to reach opening 640 or port 646 which is then communicated through pathway 647 to the pressure side 653 of actuation piston 652 resulting in closure; or that wellbore pressure also reaches the inlet 654 such that the pressure on the pressure side 653 is identical to the pressure on the actuation side 651 (caused by failure of both 632, 634 or 636, 638) and the spring then takes over and closes the WRSV 600.

Figure 8:
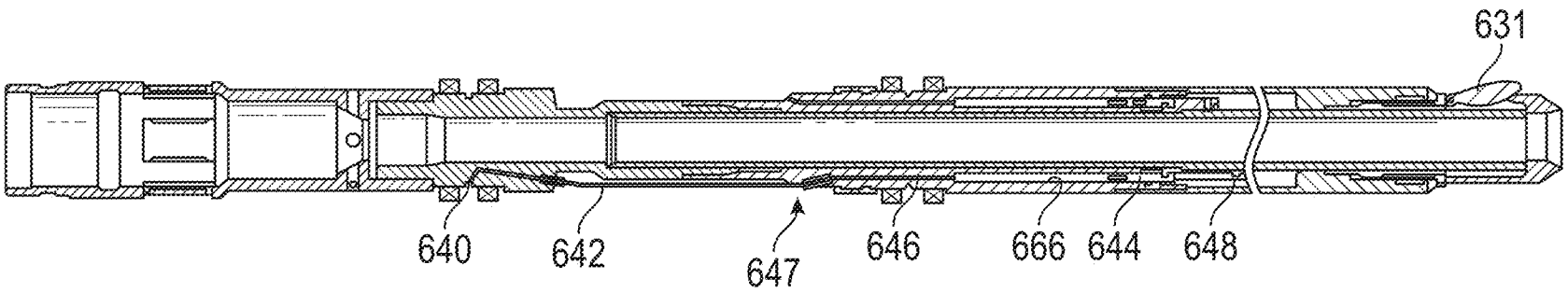
FIG. 8 is a cross sectional view of the WRSV in an open position.

In an embodiment as illustrated in the valve closed condition, pressure coming through seals 632, 634, 636 or 638 will be communicated through conduit 642 to fluid exclusion piston 644. That pressure will cause fluid exclusion piston 644 to move the flow tube 624 toward the flapper 631, but recall the space 626. As a result of space 626, the stroke capability of the flow tube 624 before the flapper 631 is contacted is greater than the stroke available to the fluid exclusion piston 644 before seal ring 648 leaves the seal bore 666, which position is illustrated in FIG. 8. Once the seal ring 648 leaves the seal bore 666, the fluid exclusion piston 644 is no longer capable of moving the flow tube 624. And since the pressure chamber 658 is at atmospheric pressure (or in any event at a significantly lower pressure than the ambient wellbore pressure), the fluid (e.g. wellbore fluid) that was formerly segregated by seal ring 648 and causing the fluid exclusion piston 644 to move is now fluidly communicated with the pressure chamber 658. In this condition, any subsequent the leaking of wellbore fluid will simply drain into pressure chamber 658. To the extent the pressure chamber 658 becomes pressurized with the leaking of wellbore fluids, that pressure is communicated to the pressure side 653 of actuation piston 652 (as noted above) and thereby decreases the resultant opening force being applied by the hydraulic control fluid. Ultimately, the leaking of wellbore fluids in the valve open condition can only result in an outcome wherein the opening force is reduced and the WRSV 600 necessarily fails closed.

Since it is often the case that seals 632, 634, 636 and 638 would fail slowly rather than catastrophically, the WRSV 600 also is useful to provide feedback to surface as to its own condition. This is because as fluid pressure rises in the pressure chamber 658, the pressure required on the original control line (shown in FIGS. 9-13 and 17-20) must be raised to keep the WRSV 600 open. This increasing pressure requirement can be registered at surface (or other control position) to determine that at least one of the seals 632, 634, 636, 638 may be leaking and maintenance or replacement is warranted. In addition, the fact that the fluid exclusion piston 644 is mechanically connected to the flow tube 624 means that a sudden failure of the seals 632, 634, 636 or 638 will cause the flow tube 624 to rapidly change position (within the bounds of space 626 in the valve closed position). The change in position of flow tube 624 will cause a pressure drop in the control line that may be registered at a remote control location, e.g. surface.

Finally, it is noted that while running the WRSV 600 to its target deployed location, the seals 632, 634, 636, 638 are not set and the opening 640 and port 646 are open to wellbore fluid, which naturally increases in hydrostatic pressure with increasing depth. The increasing hydrostatic pressure will mimic a leak of the set seals as described above. In extreme cases, the pressure chamber 658 could be filled with hydrostatic fluid before the tool is even set, rendering the tool useless although still failed in the closed position. Hence it is desirable in some embodiments or for some utilities that the flow tube 624 be releasably retained for run in. This may be carried out by a release member 668 such as a shear member that may be released by applied pressure on actuation piston 652. Alternatively, it may be desirable to configure the running tool with a retaining appendage such as an internal collet to physically hold the flow tube 624 in position for the running operation. The collet may then be released once the WRSV 600 is set.

The WRSV 600 is contemplated to be a part of a borehole system having for example a tubular string running into a subsurface environment, the string possibly including an SCSSV the function of which may need to be replaced by the WRSV 600 described herein.

Figure 9:
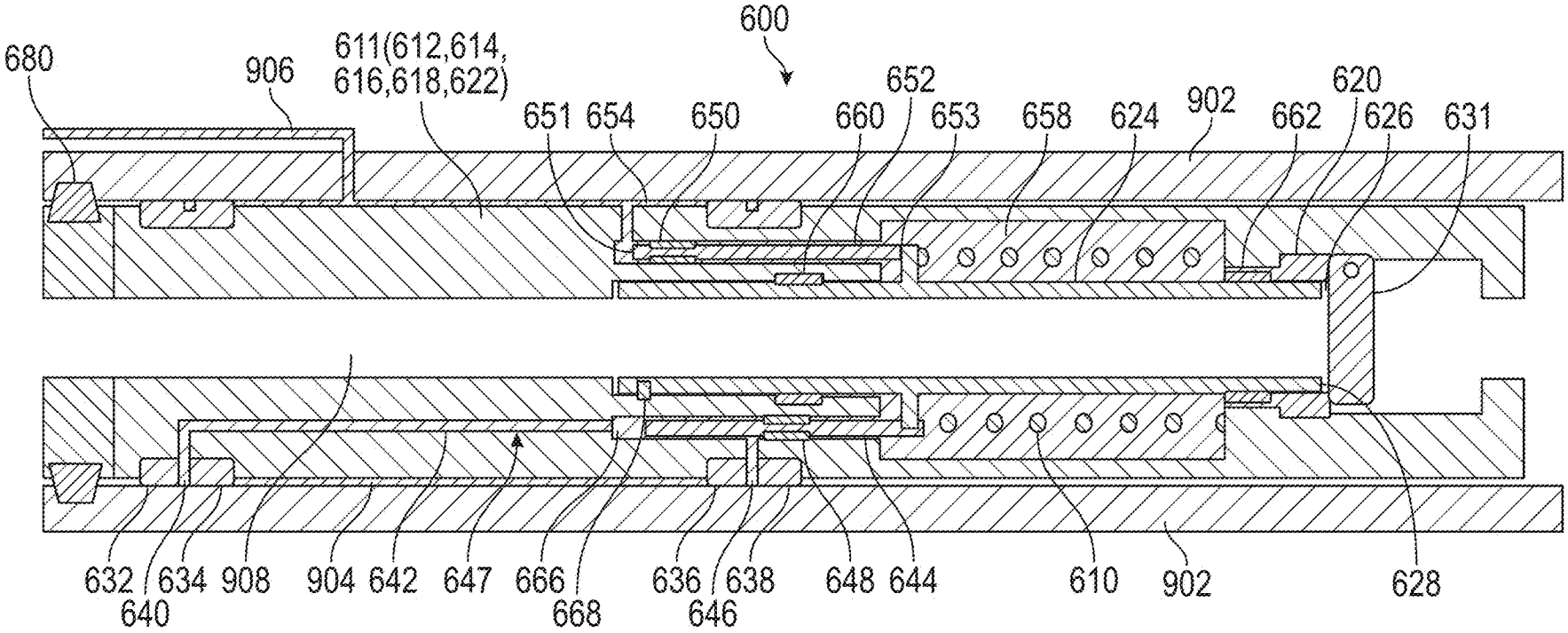
FIG. 9 shows the valve disposed in a closed position at its deployed location within a tubular.

FIG. 9 shows the WRSV 600 disposed in a closed position at its deployed location within a tubular 902. Those skilled in the art will appreciate that the tubular 902 can be a pre-existing tubular, a Landing Nipple, or an otherwise inoperable TRSV into which the WSRV 600 is disposed. The valve 600 is secured within the tubular 902 in part by a traditional lock assembly including locking dogs 680. Seals 632, 634 and seals 636, 638 are placed up against the interior wall of the tubular 902 to form an annulus 904 between the tool housing 611 and the tubular 902. A control line 906 passes through the tubular 902, forming a volume of hydraulic pressure including the control line 906, annulus 904 and inlet 654 that allows control of pressure applied at the actuation side 651 of actuation piston 652. A fail-closed situation can occur when one or more of seals 632, 634, 636 and 638 leaks, allowing the hydraulic control fluid in the annulus 904 to leak outside of the annulus.

Valve 600 is shown in the closed position in FIG. 9. Spring 910 in the pressure chamber 658 is in an extended position to press the flow tube 624 toward the closed position. A release member 668, such as a shear pin, can maintain the flow tube 624 in the closed position during run-in. Once the valve 600 has been set in its position within the tubular 902, a sufficient force can be applied to break the release member 668. The fluid exclusion piston 644 and seal ring 648 serve as a temporary plug in the seal bore 666, isolating the pressure chamber 658 from wellbore pressure. The seal bore 666 and conduit 642 form a fluid pathway 647 between the pressure chamber 658 and the opening 640 and/or port 646. Seal rings 660 and 662 prevent wellbore fluids from traveling between bore 908 and flow tube 624 and leaking into pressure chamber 658 in any valve condition (i.e. static or dynamic).

Figure 10:
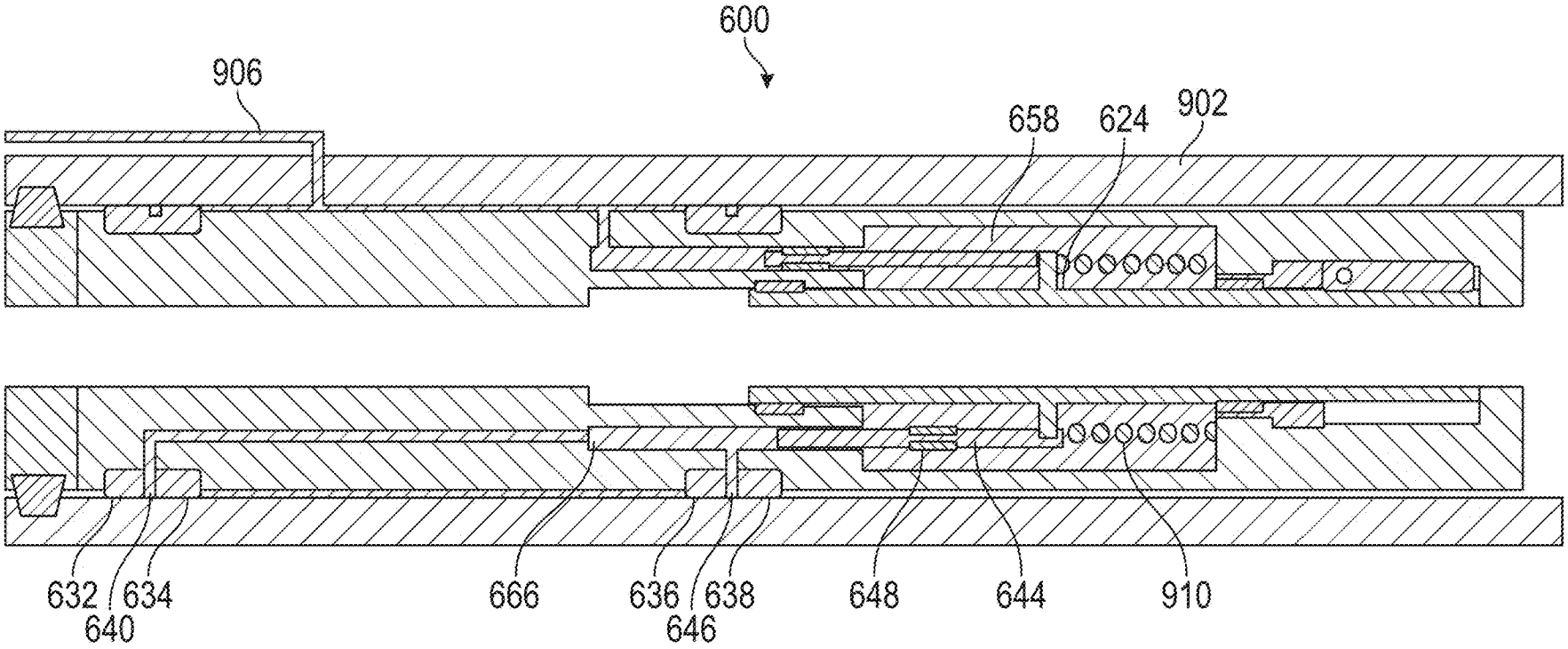
FIG. 10 shows the valve in an open position.

FIG. 10 shows the valve 600 in an open position. The pressure applied via control line 906 is increased to overcome the pressure in the pressure chamber 658 and a resistive force of spring 910, thereby moving flow tube 624 into the open position. In this position, the fluid exclusion piston 644 and seal ring 648 are moved out of the seal bore 666, leaving the possibility of exposure of the pressure chamber 658 to wellbore fluid upon a leakage of one or more of seals 632, 634, 636 and 638. The fluid exclusion piston 644 can exit and re-enter the seal bore 666. In an alternate embodiment, the fluid exclusion piston 644 can be configured to exit the seal bore 666 permanently (i.e. with no reentry) after the valve has been landed. In this alternate embodiment, at least one locking mechanism (such as a collet) can be used to prevent fluid exclusion piston 644 from reentering the seal bore 666.

Figure 11:
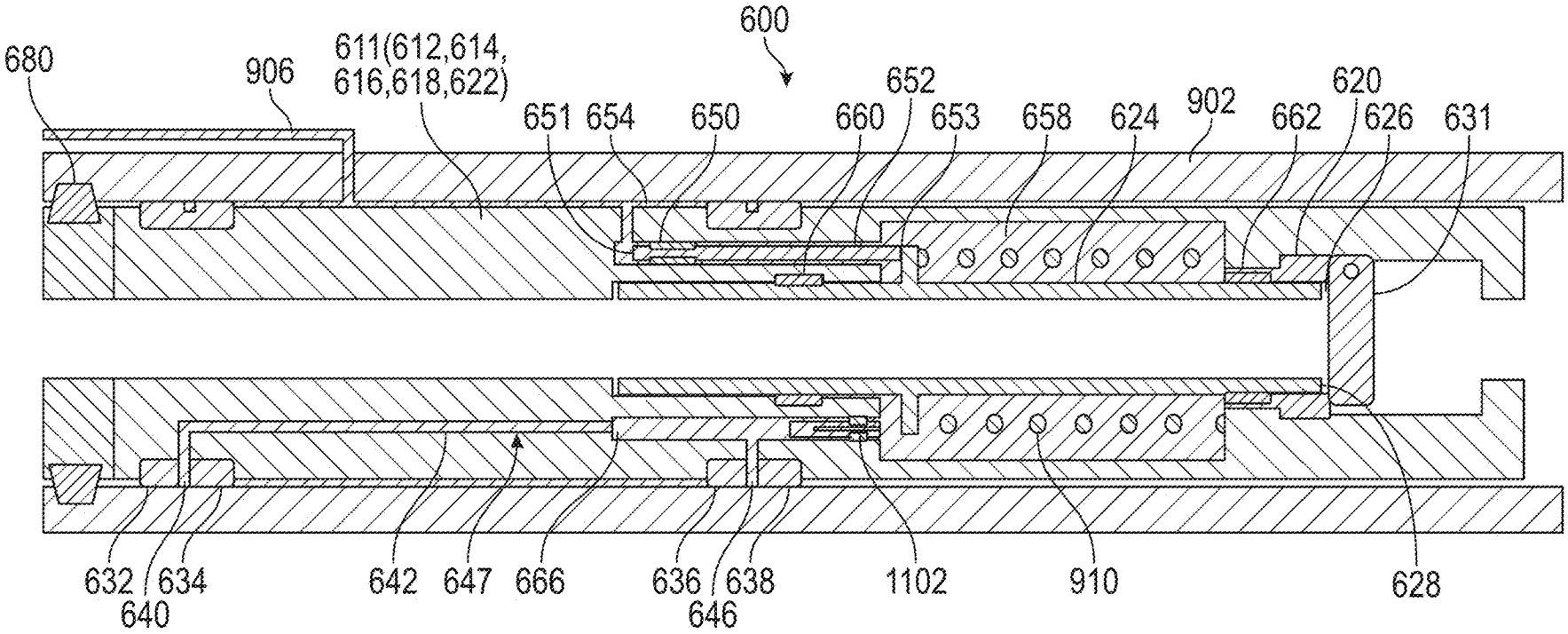
FIG. 11 shows a valve in an alternate embodiment employing a dissolvable plug.
Figure 16:
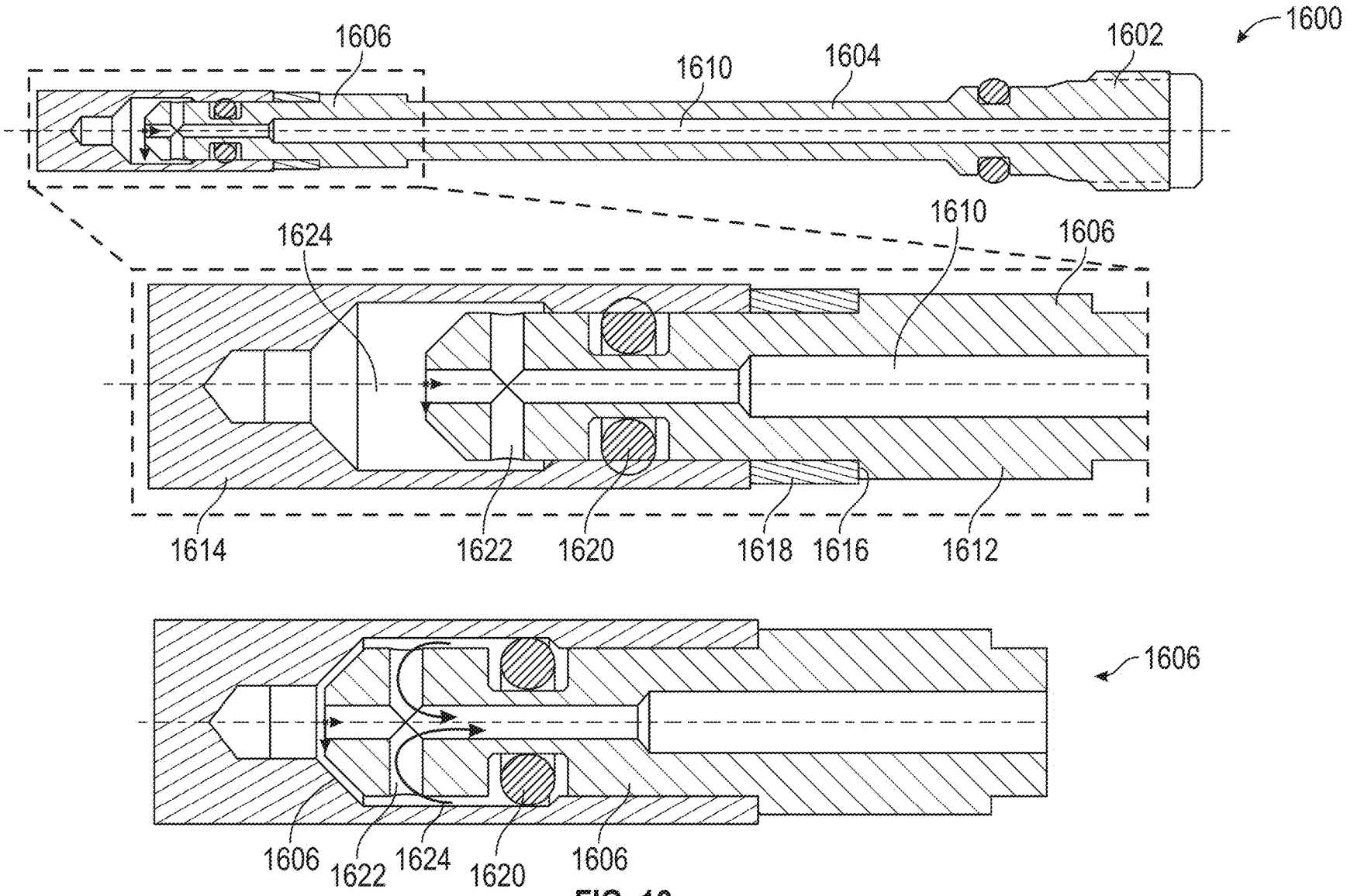
FIG. 16 shows a plug for the seal bore of FIG. 11 in an alternative embodiment.

FIG. 11 shows a valve 600 in an alternate embodiment employing a dissolvable plug 1102 disposed in the seal bore 666 for isolating the pressure chamber 658 from wellbore pressure. The plug 1102 isolates the pressure chamber 658 from outside pressure while the valve 600 is being run into the wellbore. In comparison with the previously described embodiment, which included a fluid exclusion piston 644 (ref. FIGS. 5-6 and 16) as the temporary sealing element and required a means of maintaining the flow tube 624 in the closed position during run-in, the current embodiment with dissolvable plug 1102 does not require flow tube restraint at any time for its functionality. To that end, the plug 1102 provides zonal isolation for a predetermined time duration (as discussed more later) no matter the flow tube position and therefore simplifies the run-in configuration.

In various embodiments, the plug 1102 is dissolvable member. The plug 1102 may be made of any suitable dissolvable material, such as a magnesium-based alloy such as Intallic. In various embodiments, At least a portion of the plug can be made of a powder metal compact. Additional dissolvable material can be found for example in U.S. Pat. No. 8,528,633, the contents of which are incorporated herein by reference. In another embodiment, the plug 1102 can be made of a material that liquefies at a selected temperature. The plug is in a solid form below the selected temperature and melts at a specified temperature. The specified temperature can be an operating temperature of the valve traditionally associated with the expected flowing temperature of the production fluids. In this embodiment, the pressure chamber 658 is ensured to be isolated from wellbore fluid ingress during the entire run-in operation wherein operating temperatures are generally cooler and based on the shut-in (i.e. non-flowing) thermal temperatures of the surrounding formation. Upon bringing the well online, the temperature increase due to the hot production fluids flowing through the valve I.D. will cause at least a portion of the plug to melt and the desired fluid communication through the fluid pathway 647 to be established with the WRSV properly located its deployed location.

In various embodiments wherein at least one portion of the plug 1102 is in a solid phase at run-in temperatures and transitions to a liquid phase at or above flowing temperatures (250° F. for example), the material could be a low melting point ternary or binary metal alloy such as Bi—Sn, In—Sn, Sn—Pb—Bi, Sn—Ag—Cu. The material could also be a specialized alloy with an engineered liquidus temperature, adjusted by selecting the proper alloying elements and their appropriate mass ratios according to phase diagrams. Noting the high pressures that could be observed by plug during run-in (on the order of 10,000 psi for example), the plug material may not just be the low melting point base alloy, but instead a new engineered metal with additional strength reinforcement additives dispersed within the base alloy. Without such strengthening mechanisms, the base alloy alone could become too soft when the run-in temperature is close to its melting point, and the risk of extrusion under pressure and subsequently the loss of the seal prematurely is appreciated. The noted reinforcement additives would not significantly alter the melting point of the base alloy system but rather increase the plug's strength, and therefore its high pressure rating.

In embodiments wherein at least a portion of the plug 1102 is dissolvable, once the valve 600 has been run in and landed at its deployed location within the tubular 902, the plug 1102 can dissolve to allow a pressure equalization between seal bore 666 and the pressure chamber 658. The dissolution rate of the plug 1102 can be known and can be selected to be greater than the time needed to run in the valve 600 to its deployed location within the tubular 902, thereby assuring that the pressure chamber 658 is isolated during run-in.

Figure 12:
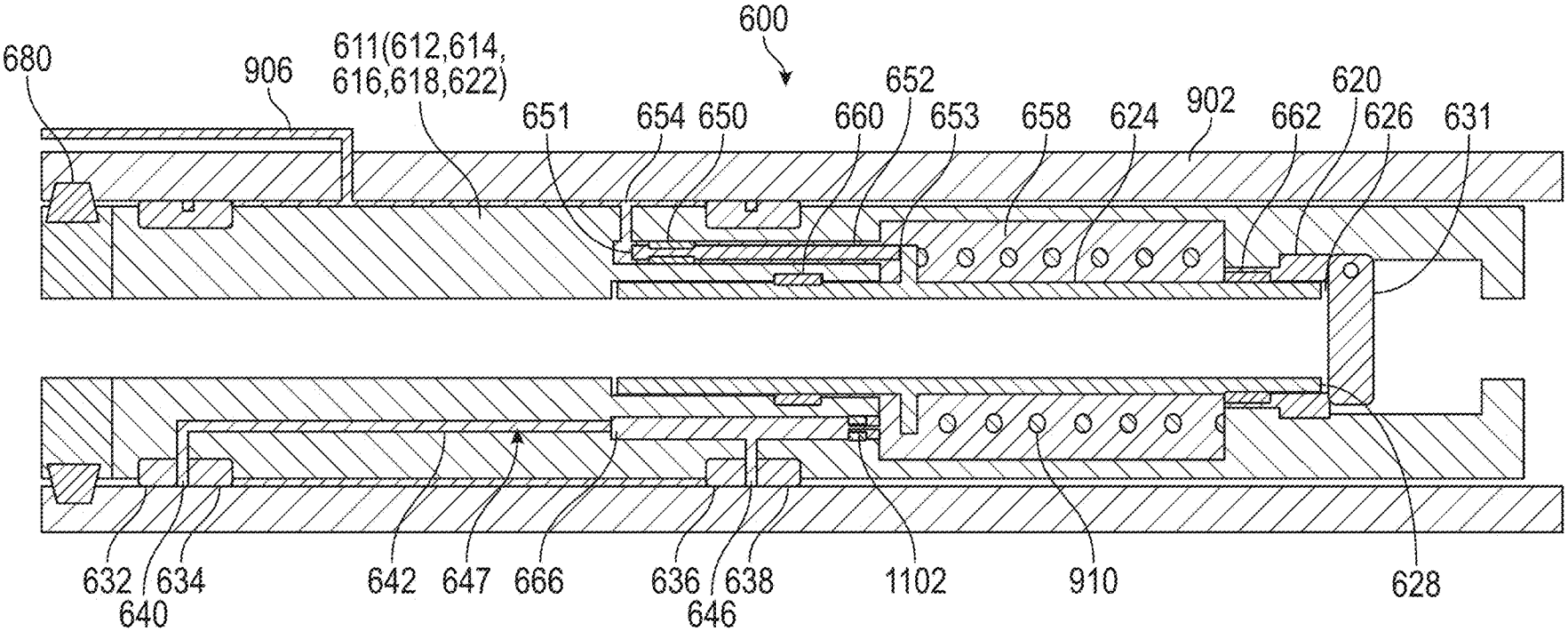
FIG. 12 shows the valve of FIG. 11 in a closed position with the plug dissolved.

FIG. 12 shows the valve 600 of FIG. 11 in a closed position with the plug 1102 dissolved. Dissolution of the plug 1102 creates fluid communication between the pressure chamber 658 and the seal bore 666. Creating this fluid communication does not change the pressure in the pressure chamber 658 to significantly alter the pressure balance between the actuation side 651 of the actuation piston 652 and the pressure side 653 of the actuation piston 652.

Figure 13:
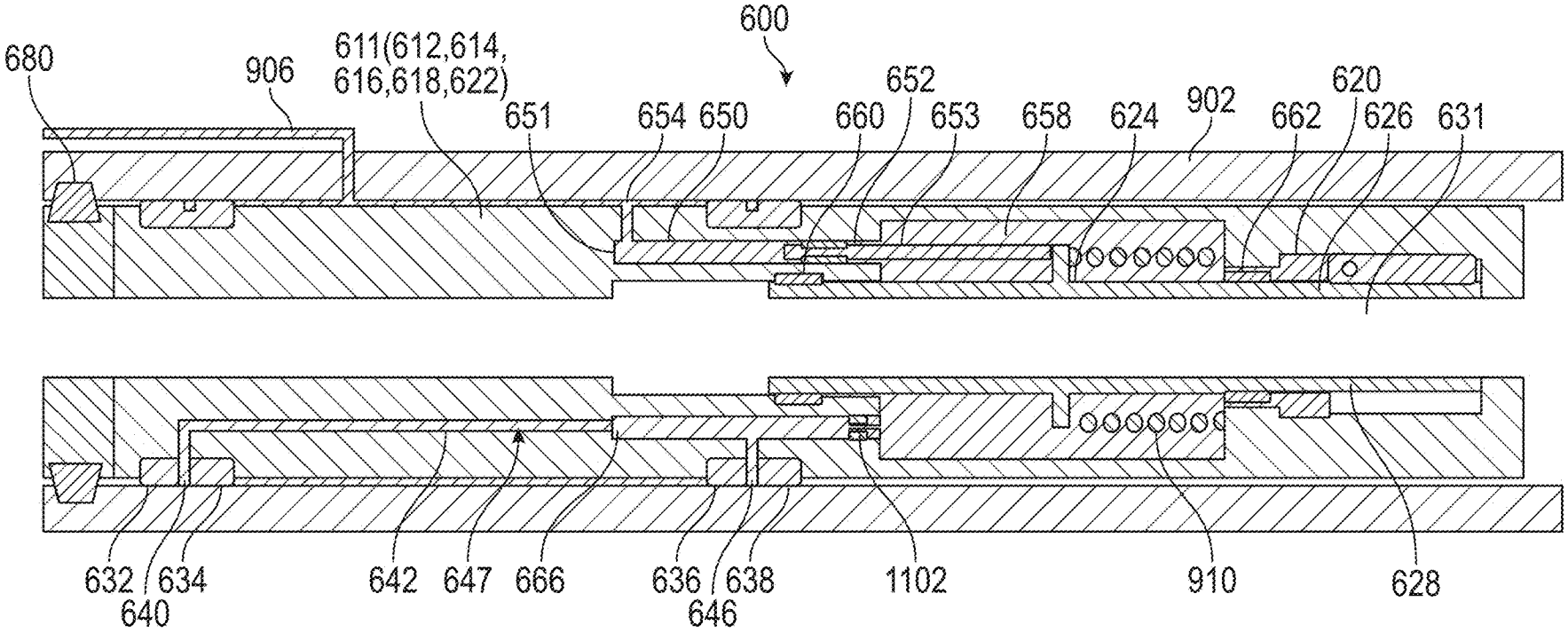
FIG. 13 shows the valve of FIG. 11 in an open position.

FIG. 13 shows the valve 600 of FIG. 11 in an open position. The pressure in the control line 906 (on the actuation side 651 of the actuation piston 652) has been increased to be greater than the pressure in the pressure chamber 658 (on the pressure side 653 of the actuation piston 652), thereby causing a net force on the actuation piston 652 that activates or pushes the flow tube 624 into the open position.

Figure 14A:
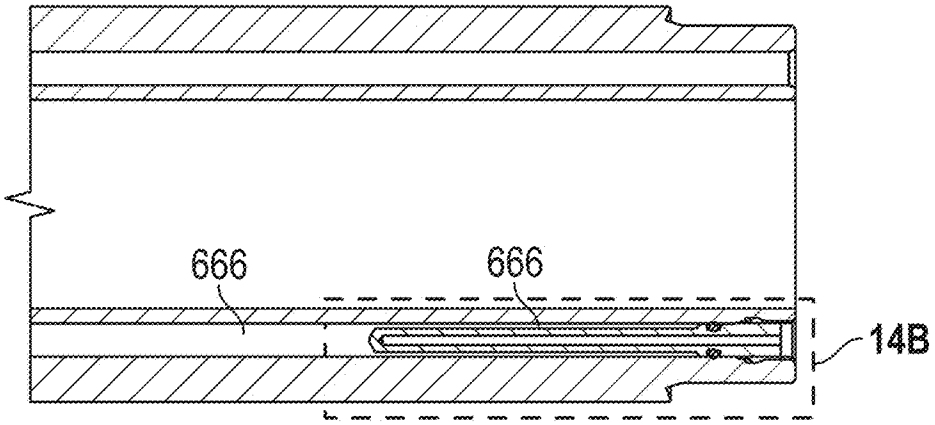
FIG. 14A shows a close-up view of the seal bore of the valve of FIG. 11, including the dissolvable plug.
Figure 14B:
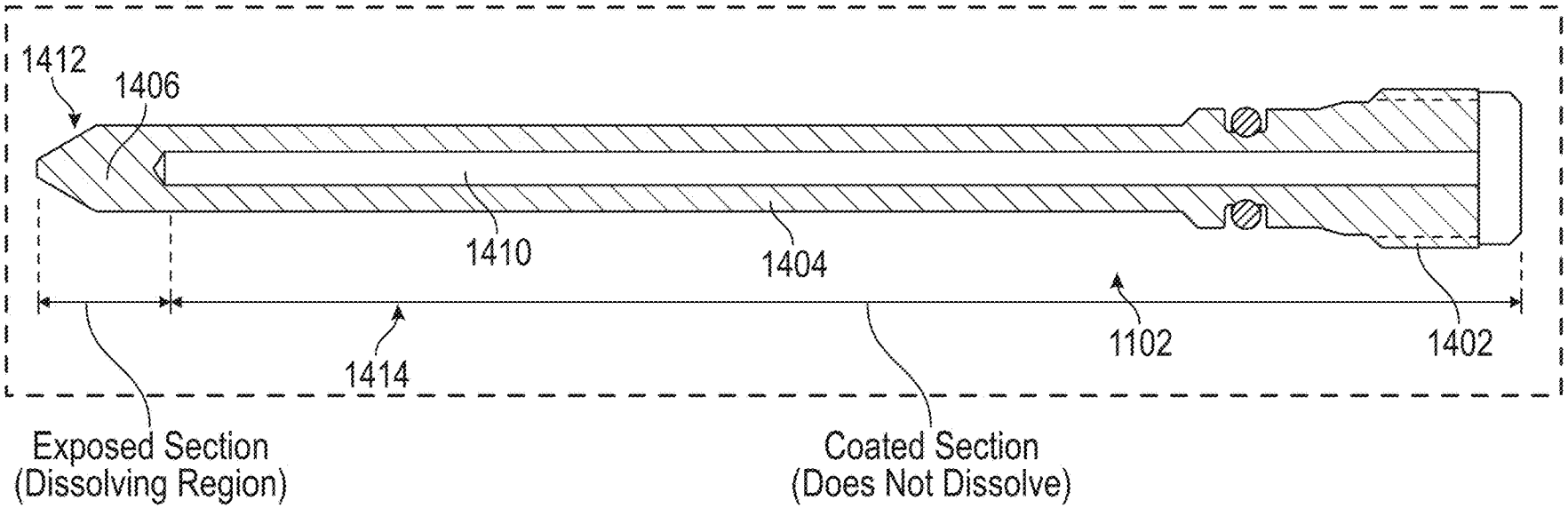
FIG. 14B shows an expanded view of the plug of FIG. 14A.

FIG. 14A shows a close-up view of the seal bore 666, including plug 1102. FIG. 14B shows an expanded view of the plug of FIG. 14A. The plug 1102 includes a root 1402, a shaft 1404 and a tip 1406. The root 1402 is used to secure the plug 1102 in the seal bore 666, with the shaft 1404 and tip 1406 directed away from the pressure chamber 658 and toward the opening 640 and/or port 646. The shaft 1404 and tip 1406 are therefore exposed to any fluid in the seal bore 666. The shaft 1404 includes a passage 1410 that extends from the root 1402 to the tip 1406. The passage 1410 is open to the pressure chamber 658 at the root 1402 and is closed off at the tip 1406 until the tip 1406 is dissolved.

The root 1402 and shaft 1404 form a coated section 1414 that includes a coating of protective material that forms a barrier between the fluid in the seal bore 666 and the root 1402 and shaft 1404, thereby preventing or hindering the dissolution of the root and shaft. The tip 1406 forms an uncoated section 1412 that is exposed to the fluid in the seal bore 666. In various embodiments, the tip 1406 or the entire plug 1102 can be the solid material that liquefies at a selected operating temperature of the valve.

Figure 15:
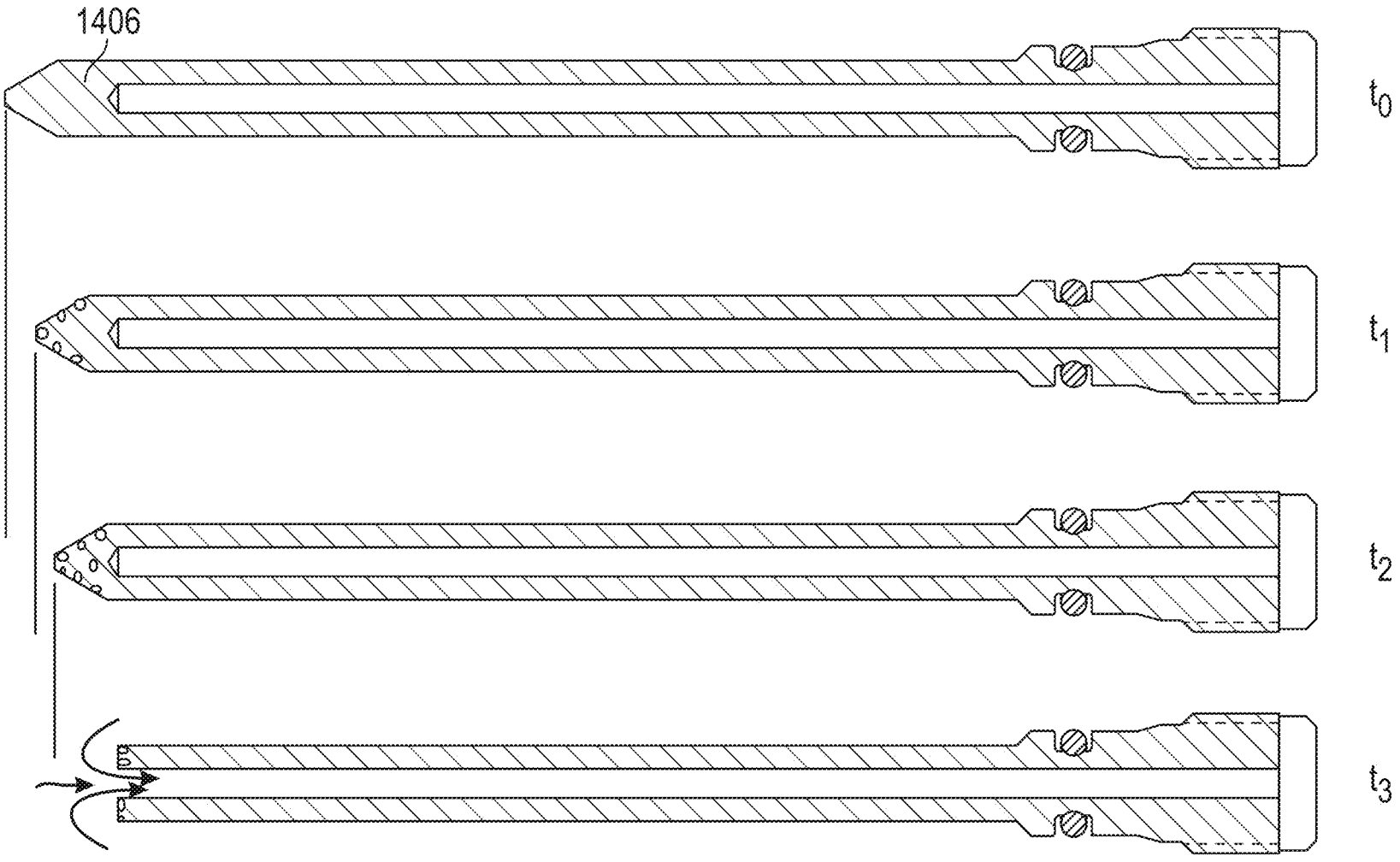
FIG. 15 shows a time series illustrating dissolution of the tip of the plug of FIGS. 14A and 14B.

FIG. 15 shows a time series illustrating dissolution of the tip 1406 of the plug 1102. The tip 1406 dissolves in a manner that allows dissolved material to fall away from the plug 1102, thereby reducing an amount debris influx at the tip 1406 when the last layer of the tip 1406 is dissolved. From time $t_0$ to $t_1$ and from time $t_1$ to $t_2$, the outermost surface of the tip can be seen to dissolve and fall away. At time $t_3$, when the last part of the tip 1406 is dissolved, the original material from the tip has mostly fallen away, leaving little or no debris remaining at the tip that might otherwise clog the passage 1410.

FIG. 16 shows the plug 1102 in an alternative embodiment. The plug 1102 includes the root 1602, shaft 1604 and tip 1606, with a passage 1610 extending from the root to the tip. The passage 1610 is open at the root 1602. The tip 1606 includes a stem 1612 and a sleeve or cap 1614 that is slidable along the stem 1612. The stem 1612 includes a ridge 1616 providing a recessed region in which the cap 1614 can move. A dissolvable material 1618 is disposed in the recessed region, forming a collar between the ridge 1616 and the cap 1614. Fluid pressure on the cap 1614 pushes the cap towards the stem 1612 or ridge 1616.

The cap 1614 includes one or more ports 1620 that allow fluid to pass from outside of the cap to inside the cap. The stem 1612 includes various inlets 1622 that are connected to the passage 1610. The dissolvable material 1618 resists fluid forces in the seal bore 666 that are pushing the cap 1614 towards ridge 1616 to thereby maintain the cap 1614 in a first position. In the first position, the cap 1614 is extended from the stem 1612. An interior cavity 1624 can be seen in FIG. 16 between the cap 1614 and stem 1612 in the first position. In the first position, the one or more ports 1620 of the cap 1614 are unaligned with the inlets of the stem. Once the dissolvable material 1618 dissolves, the fluid pressure in the seal bore 666 presses the cap 1614 into a second position against the ridge 1616. In the second position, the one or more ports 1620 of the cap 1614 area are either aligned with the inlets 1622 or are in fluid communication with the inlets 1622 via the cavity 1624, thereby allowing for fluid communication between the seal bore 666 and the pressure chamber 658. In the plug 1102 of FIG. 16, the dissolvable material 1618 does not seal off the pressure of the seal bore 666, but rather serves as a temporary latch or restraint against the cap 1614 until the dissolvable material 1618 is dissolved. In various embodiments, the dissolvable material 1618 can be the solid material that liquefies at a selected operating temperature of the valve.

Figure 17:
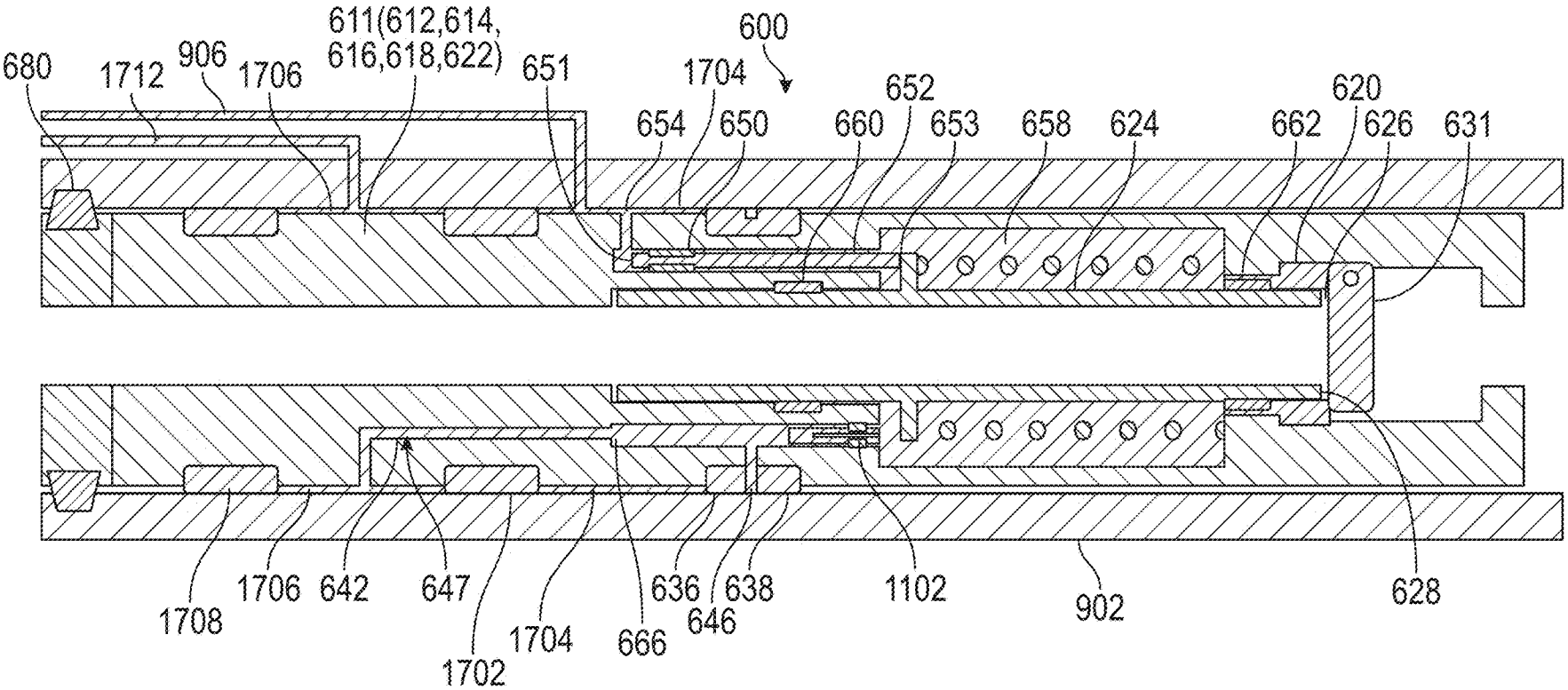
FIG. 17 shows a valve in another embodiment in which the pressure supplied by a control line is counteracted by a balance pressure supplied via a balance line.

FIG. 17 shows a valve 600 in another embodiment in which the pressure supplied by control line 906 is counteracted by a balance pressure supplied via a balance line 1712. The valve 600 includes seals 636 and 638 surrounding port 646, and a second seal 1702 axially separated from seals 636 and 638 to form a first annulus 1704 through which hydraulic fluid is provided from the control line 906 to the actuation side 651 of the actuation piston 652. Additionally, a third seal 1708 is placed on the housing 611 axially separated from the second seal 1702 to form a second annulus 1706 through which a balancing hydraulic fluid can be provided to the pressure chamber 658 (and pressure side 653 of actuation piston 652) via the balance line 1712.

In one embodiment, the valve 600 can include plug 1102 disposed in seal bore 666, the plug 1102 being dissolvable once the valve 600 has been run-in to its deployed location within the tubular 902. The plug 1102 can then be dissolved to allow fluid communication between pressure chamber 658, seal bore 666, conduit 642, second annulus 1706 and balance line 1712. The pressure in the balance line 1712 can then be used to control a pressure at the pressure side 653 of the actuation piston 652. The balance pressure in the balance line 1712 can adjusted in comparison to the pressure in the control line 906 in order to control the forces on the flow tube 624, moving the flow tube 624 between closed positon shown in FIG. 17 and the open position, shown in FIG. 18.

Figure 18:
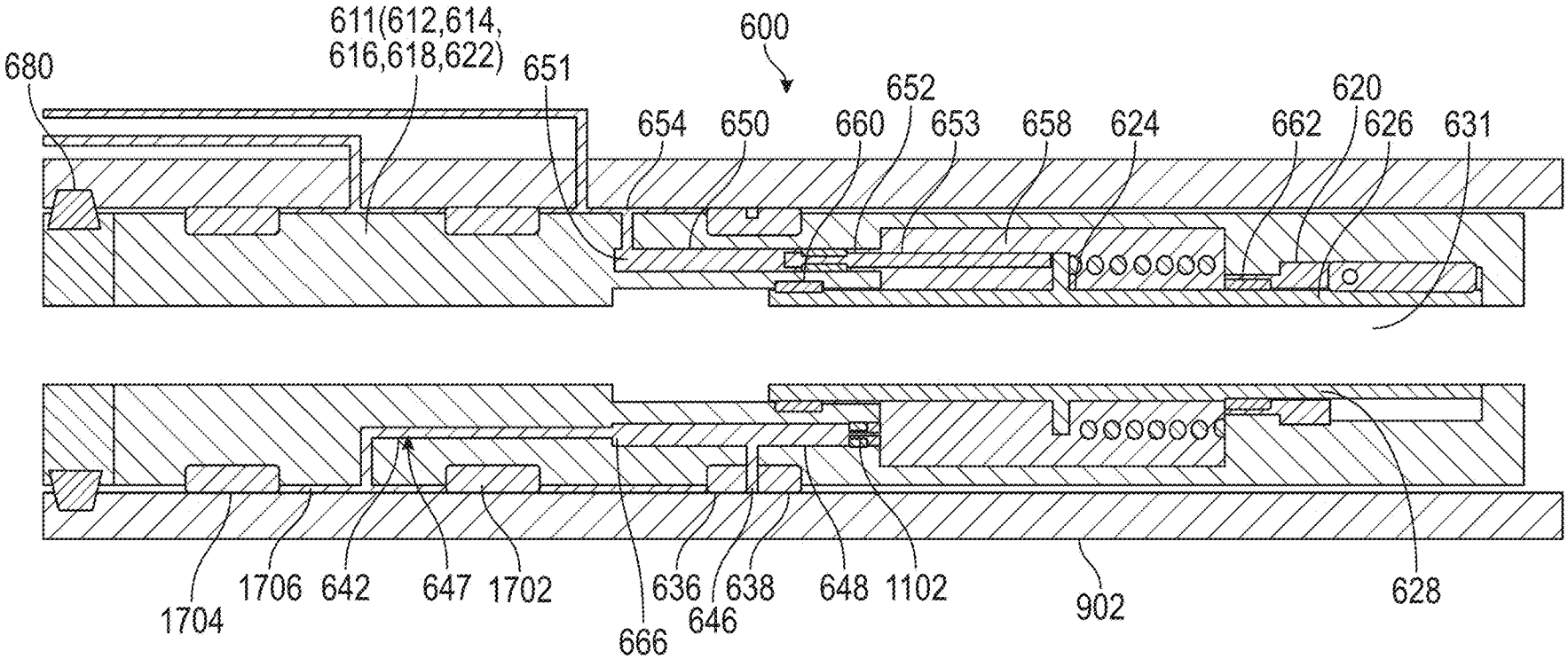
FIG. 18 shows the valve of FIG. 17 in the open position.

FIG. 18 shows the valve 600 in the open position. The pressure in the hydraulic control line 906 is increased above the pressure in the balance line 1712, leading to the pressure on the actuation side 651 of the actuation piston 652 overcoming the pressure on the pressure side 653 of the actuation piston 652 and the spring force. As a result the flow tube 624 is moved into the open position. Those skilled in the art will appreciate the fact that a temporary sealing member (in this case, plug 1102) is unnecessary in this embodiment for the purposes of ensuring fail-safe closed operation due to the presence of the balance line 1712. Instead plug 1102 in this embodiment serves the primary purpose of preventing wellbore fluid and debris ingress into pressure chamber 658 during run-in.

Figure 19:
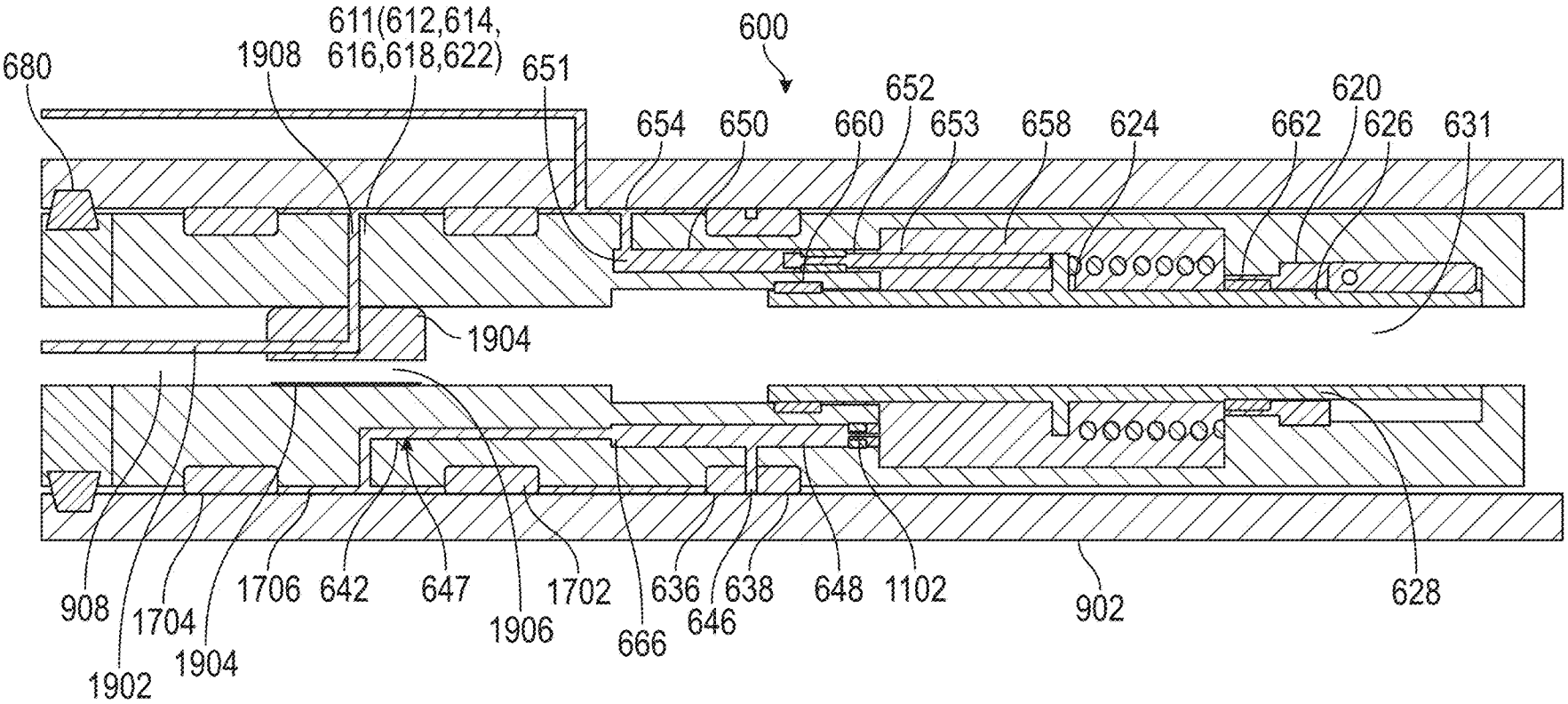
FIG. 19 shows an alternate embodiment of the valve of FIG. 17 including the balance line extending through a bore of the valve.

FIG. 19 shows an alternate embodiment of the valve 600 shown in FIG. 17. The balance line 1902 is disposed within the bore 908 of the valve 600, rather than outside of the tubular 902 as in FIG. 17. The valve 600 can be conveyed downhole via a tubular such as tubular string 30 and the balance line 1902 can extend through the tubular string 30 to the valve 600. The balance line 1902 passes through the valve 600 via a seal 1904. The seal 1904 includes a passage 1906 to allow fluid flow through the bore 908. A lateral passage 1908 provides a fluid path from the balance line 1902 to the second annulus 1706, thereby providing pressure communication between balance line 1902 and pressure chamber 658 by way of passage 1908, second annulus 1706, conduit 642 and seal bore 666.

Figure 20:
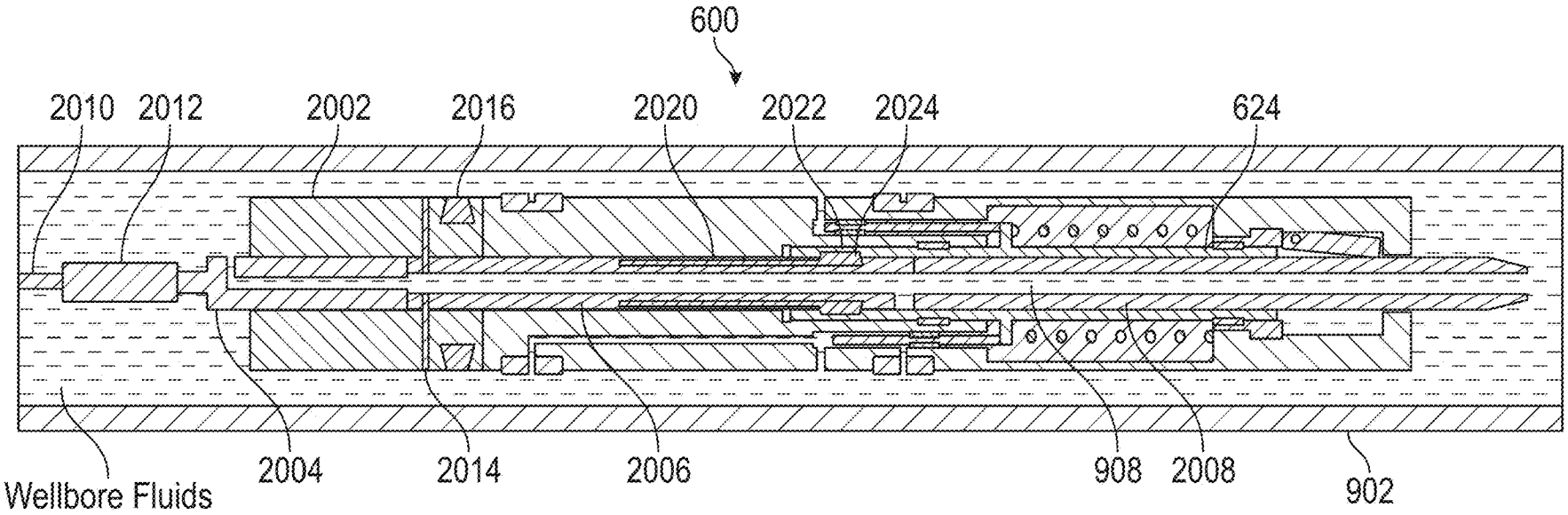
FIG. 20 illustrates a valve being conveyed on a run-in assembly of a wireline.

FIG. 20 illustrates a valve being conveyed on a run-in assembly of a wireline 2010. The valve 600 includes a lock 2002 at its uphole end. A run-in tool assembly 2004 is connected to the wireline 2010 via a spang jar 2012. The run-tool assembly 2004 is coupled to a latch assembly 2006 which is coupled to a spacer tube 2008. The combination of run-in tool assembly 2004, latch assembly 2006 and spacer tube 2008 extends through the bore 908 of the valve and provides a fluid passage through which wellbore fluid can pass during run-in. The lock 2002 includes internal shear pins 2014 at an internal passage and locking dogs 2016 at an exterior surface. The shear pins 2014 couple the lock 2002 to the latch assembly 2006 during run-in. Once the valve is at its deployed location, locking dogs 2016 can be deployed radially outward to engage the tubular 902, thereby securing the valve in place. The shear pins 2014 can be broken upon a downward jarring motion applied to the latch assembly 2006. The run-in tool assembly 2004, latch assembly 2006 and spacer tube 2008 can then be retrieved uphole.

The latch assembly 2006 includes a collet 2020 that couples the latch assembly 2006 to the flow tube 624 in order to hold the flow tube in place during run-in. The collet 2020 includes fingers 2022 that engages with a profile 2024 in an internal surface of the flow tube 624 during run-in. The fingers 2022 can be disengaged from the profile 2024 with an over-pull or other mechanical sequence that provides a suitable force. In another embodiment wherein an internal profile within the flow tube 624 is not desirable, the collet

2020 can be replaced with a system of mechanically engaged dogs or "slips" that rely on radial interference during run-in to restrain the flow tube from downward movement. After landing in the deployed location for the WRSV, the dogs or slips can be disengaged via a mechanical sequence of motions (including downward jarring and upward overpull) to release the latch assembly 2006 from flow tube 624.

The embodiment of the valve shown in FIG. 20 allows the spring 910 to be sized to lift just one piston instead of two (i.e. the actuation piston 652 and fluid exclusion piston 644), which helps keep the hydraulic operating pressure for opening the WRSV low further enabling WRSV to be installed within an existing tubing pressure insensitive (and low operating pressure) TRSV downhole. Also, the use of a collet or slips ensure the fluid exclusion piston 644 stays within the seal bore 666 during run-in and does not inadvertently stroke out, which would allow pressure communication before landing in place. In this configuration, the internal spring does not have to be strong enough to lift two pistons during run-in.

Set forth below are some embodiments of the foregoing disclosure:

Embodiment 1: A tubing pressure insensitive failsafe wireline retrievable safety valve. The valve includes a tool housing, a flow tube disposed within the tool housing, an actuation piston disposed in the tool housing and operably connected to the flow tube, the actuation piston having an actuation side and a pressure side, and a fluid pathway between a potential leak site for the valve and the pressure side of the piston.

Embodiment 2: The valve of any prior embodiment, further including a temporary sealing component disposed in the fluid pathway between the potential leak site and the pressure side of the actuation piston.

Embodiment 3: The valve of any prior embodiment, wherein the temporary sealing component includes a piston and seal positioned to exit a bore in which the seal is disposed.

Embodiment 4: The valve of any prior embodiment, wherein the temporary sealing component is permanently disabled after the valve is set downhole.

Embodiment 5: The valve of any prior embodiment, wherein at least a portion of the temporary sealing component dissolves due to fluid exposure.

Embodiment 6: The valve of any prior embodiment, wherein the temporary sealing member dissolves via a chemical reaction with a reactive environment contained within the fluid pathway.

Embodiment 7: The valve of any prior embodiment, wherein the at least one portion is made of a powder metal compact.

Embodiment 8: The valve of any prior embodiment, wherein the fluid pathway is filled with a chemically reactive fluid prior to running the valve downhole.

Embodiment 9: The valve of any prior embodiment, wherein the temporary sealing component is removed from the fluid pathway after the valve is landed in its operable location downhole.

Embodiment 10: The valve of any prior embodiment, wherein the temporary sealing component comprising a material that is solid below a specified temperature of the valve and is liquid at or above the specified temperature.

Embodiment 11: The valve of any prior embodiment, further comprising a pressure chamber at the pressure side of the actuation piston.

Embodiment 12: The valve of any prior embodiment, further comprising a pressure chamber at the pressure side of the actuation piston, wherein the temporary sealing component is configured to vent to the pressure chamber upon a selected pressure from the potential leak site.

Embodiment 13: The valve of any prior embodiment, wherein the pressure chamber is partially defined by a seal between the housing and the flow tube.

Embodiment 14: The valve of any prior embodiment, wherein the flow tube includes an end defining a space between the flow tube and a flapper, the space dimensioned to ensure that the an actuation pressure at an actuation side of the actuation piston communicates a fluid pressure therein to the pressure chamber prior to the flow tube contacting the flapper.

Embodiment 15: The valve of any prior embodiment, wherein the flow tube and the housing are releasably connected together by a release member.

Embodiment 16: The valve of any prior embodiment, wherein the fluid pathway is in fluid communication with a balance line in order to supply a balance pressure to the pressure side of the actuation piston.

Embodiment 17: The valve of any prior embodiment, wherein the balance line extends through a tubular string to the valve.

Embodiment 18: The valve of any prior embodiment, further comprising a running tool configured to hold the flow tube in a closed position while running downhole.

Embodiment 19: The valve of any prior embodiment, further comprising an annular hydraulic control chamber disposed between potential leak sites.

Embodiment 20: The valve of any prior embodiment, further comprising a pressure communication system including a first tubular threadingly connected to a second tubular and a communication pathway that passes from within a wall of the first tubular to within a wall of the second tubular across a joint.

Embodiment 21: The valve of any prior embodiment, wherein the pressure communication system partially defines the fluid pathway between a potential leak site for the valve and the pressure side of the actuation piston.

Embodiment 22: A borehole system having a tubing pressure insensitive failsafe wireline retrievable safety valve. The borehole system includes a tool housing, a flow tube disposed within the tool housing, an actuation piston disposed in the tool housing and operably connected to the flow tube, the actuation piston having an actuation side and a pressure side, and a fluid pathway between a potential leak site for the valve and the pressure side of the piston.

Embodiment 23: A method of operating a tubing pressure insensitive failsafe wireline retrievable safety valve. The valve includes a tool housing, a flow tube disposed within the tool housing, an actuation piston disposed in the tool housing and operably connected to the flow tube, the actuation piston having an actuation side and a pressure side, a fluid pathway between a potential leak site for the valve and the pressure side of the piston, and a temporary sealing member in the fluid pathway between the potential leak site and the pressure side of the piston. The method includes disposing the valve at a selected location and removing at least a portion of the temporary sealing member from the fluid pathway after landing the wireline retrievable safety valve at the selected location.

Embodiment 24: The method of any prior embodiment, wherein the temporary sealing member includes a dissolvable member and removing at least the portion of the temporary sealing member further comprising dissolving the dissolvable member.

Embodiment 25: The method of any prior embodiment, wherein the removing at least a portion of the temporary sealing member allows fluid communication between the fluid pathway and the pressure side of the piston.

Embodiment 26: The method of any prior embodiment, wherein the removing at least a portion of the temporary sealing member exposes the pressure side of the piston to a pressure in a balance line.

Embodiment 27: The method of any prior embodiment, wherein the temporary sealing component comprising a material that is solid below a selected temperature and is liquid at or above the selected temperature, further comprising raising the temperature of the material above the selected temperature.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tubing pressure insensitive failsafe wireline retrievable safety valve, comprising:

a tool housing;

a flow tube disposed within the tool housing;

an actuation piston disposed in the tool housing and operably connected to the flow tube, the actuation piston having an actuation side and a pressure side;

a fluid pathway between the pressure side of the piston and a seal; and a plug in the fluid pathway to isolate the pressure side from the seal, wherein movement of the flow tube removes the plug from the fluid pathway to create fluid communication between the pressure side and the seal.

2. The valve as claimed in claim 1, wherein the fluid pathway is between the pressure side of the piston and an annular volume and the seal is in the annular volume.

3. The valve of claim 2 wherein at least a portion of the plug dissolves due to fluid exposure.

4. The valve of claim 3 wherein the plug dissolves via a chemical reaction with a reactive environment contained within the fluid pathway.

5. The valve of claim 3 wherein the at least one portion is made of a powder metal compact.

6. The valve of claim 3 wherein the fluid pathway is filled with a chemically reactive fluid prior to running the valve downhole.

7. The valve of claim 2, wherein the plug is configured to vent to the pressure chamber upon a selected pressure from the annular volume.

8. The valve as claimed in claim 1 wherein the plug includes a fluid exclusion piston and a seal ring disposed within the fluid pathway, the fluid exclusion piston being operably connected to the flow tube, wherein the seal ring is positioned to exit the fluid pathway upon movement of the fluid exclusion piston by the flow tube.

9. The valve of claim 8 wherein the fluid exclusion piston is configured to exit the fluid pathway after the valve is set downhole.

10. The valve of claim 8 wherein the flow tube includes an end defining a space between the flow tube and a flapper, the space dimensioned to ensure that the an actuation pressure at an actuation side of the actuation piston communicates a fluid pressure therein to the pressure chamber prior to the flow tube contacting the flapper.

11. The valve of claim 1 wherein the plug is removed from the fluid pathway via movement of the flow tube after the valve is landed in its operable location downhole.

12. The valve of claim 1, wherein the plug comprising a material that is solid below a specified temperature of the valve and is liquid at or above the specified temperature.

13. The valve of claim 1 further comprising a pressure chamber at the pressure side of the actuation piston.

14. The valve of claim 13 wherein the pressure chamber is partially defined between the housing and the flow tube.

15. The valve of claim 1 wherein the flow tube and the housing are releasably connected together by a release member.

16. The valve of claim 1, wherein the fluid pathway is in fluid communication with a balance line in order to supply a balance pressure to the pressure side of the actuation piston.

17. The valve as claimed in 16 wherein the balance line extends through a tubular string to the valve.

18. The valve of claim 1, further comprising a running tool configured to hold the flow tube in a closed position while running downhole.

19. The valve of claim 1, further comprising an annular hydraulic control chamber disposed between potential leak sites.

20. The valve of claim 1, further comprising a pressure communication system including a first tubular threadingly connected to a second tubular and a communication pathway that passes from within a wall of the first tubular to within a wall of the second tubular across a joint.

21. The valve of claim 20, wherein the pressure communication system partially defines the fluid pathway.

22. A borehole system having a tubing pressure insensitive failsafe wireline retrievable safety valve, comprising:

a tool housing;

a flow tube disposed within the tool housing;

an actuation piston disposed in the tool housing and operably connected to the flow tube, the actuation piston having an actuation side and a pressure side; and a fluid pathway between the pressure side of the piston and a seal; and a plug in the fluid pathway to isolate the pressure side from the seal, wherein movement of the flow tube removes the plug from the fluid pathway to create fluid communication between the pressure side and the seal.

23. A method of operating a tubing pressure insensitive failsafe wireline retrievable safety valve, comprising:

disposing the valve at a selected location, the valve comprising:

a tool housing;

a flow tube disposed within the tool housing;

an actuation piston disposed in the tool housing and operably connected to the flow tube, the actuation piston having an actuation side and a pressure side;

a fluid pathway between the pressure side of the piston; and a plug in the fluid pathway isolating the pressure side of the piston from the seal; and removing the plug from the fluid pathway via movement of the flow tube after landing the wireline retrievable safety valve at the selected location to create fluid communication between the pressure side and the seal.

24. The method of claim 23, wherein the plug a dissolvable member and removing the plug further comprises dissolving the dissolvable member.

25. The method of claim 23, wherein removing the plug allows fluid communication between the fluid pathway and the pressure side of the piston.

26. The method of claim 23, wherein removing the plug exposes the pressure side of the piston to a pressure in a balance line.

27. The method of claim 23, wherein the plug comprises a material that is solid below a selected temperature and is liquid at or above the selected temperature, further comprising raising the temperature of the material above the selected temperature.

* * * * *